US005585227A

United States Patent [19]

Ishii et al.

[11] Patent Number: 5,585,227

[45] Date of Patent: Dec. 17, 1996

[54] SILVER HALIDE COLOR PHOTOGRAPHIC LIGHT SENSITIVE MATERIAL

[75] Inventors: Yoshio Ishii; Yasuhiro Yoshioka, both of Minami-Ashigara, Japan

[73] Assignee: Fuji Photo Film Co., Ltd., Kanagawa, Japan

[21] Appl. No.: 151,206

[22] Filed: Nov. 12, 1993

Related U.S. Application Data

[63] Continuation-in-part of Ser. No. 876,404, Apr. 30, 1992, abandoned.

[30] Foreign Application Priority Data

May 1, 1991 [JP] Japan ..... 3-126486

[51] Int. Cl.$^6$ ..... G03C 1/46

[52] U.S. Cl. ..... 430/503; 430/557; 430/552; 430/553

[58] Field of Search ..... 430/503, 557, 430/553, 552

[56] References Cited

U.S. PATENT DOCUMENTS

| | | | |
|---|---|---|---|
| 4,248,961 | 2/1991 | Hagen et al. | 430/557 |
| 4,289,847 | 9/1981 | Ishikawa et al. | 430/557 |
| 4,882,267 | 11/1989 | Hirabayashi et al. | 430/553 |
| 4,892,810 | 1/1990 | Aoki et al. | 430/553 |
| 5,084,375 | 1/1992 | Umemoto et al. | 430/553 |
| 5,250,406 | 10/1993 | Yamamoto et al. | 430/557 |
| 5,273,868 | 12/1993 | Sakurazawa et al. | 430/557 |
| 5,427,902 | 6/1995 | Shimura et al. | 430/556 |

FOREIGN PATENT DOCUMENTS 0447969 9/1991 European Pat. Off. .

*Primary Examiner*—Geraldine Letscher
*Attorney, Agent, or Firm*—Birch, Stewart, Kolasch & Birch, LLP

[57] ABSTRACT

A silver halide color photographic light-sensitive material has, on a support, at least one red-sensitive silver halide emulsion layer, at least one green-sensitive silver halide emulsion layer, and at least one blue-sensitive silver halide emulsion layer. The blue-sensitive silver halide emulsion layer contains a specified acylacetamide type yellow dye-forming coupler. The red-sensitive silver halide emulsion layer contains a specified phenol type cyan coupler.

11 Claims, No Drawings

SILVER HALIDE COLOR PHOTOGRAPHIC LIGHT SENSITIVE MATERIAL

CROSS-REFERENCE TO THE RELATED APPLICATION

This application is a continuation-in-part of U.S. patent application Ser. No. 07/876,404 filed on Apr. 30, 1992, now abandoned.

BACKGROUND OF THE INVENTION

1. Field of the Invention

The present invention relates to a silver halide color photographic light-sensitive material and, more particularly, to a silver halide color photographic light-sensitive material in which a coloring stain caused during development processing and a coloring stain caused with time after development processing are reduced.

2. Description of the Related Art

A silver halide color photographic light-sensitive material is exposed imagewise, developed by an aromatic amine-based color developing agent, and forms a dye image upon reaction between a finally produced oxidized form of the developing agent and a dye image forming coupler (to be referred to as a coupler hereinafter). This coupler used in the color photographic light-sensitive material is generally a combination of yellow, cyan, and magenta couplers.

These couplers cause coloring stains regardless of the types of couplers. That is, the couplers in non-exposed portions are colored more or less during or after development processing due to deterioration of developing solutions, and compositions used in a development process, such as a color developing solution, a bleach solution, a fixing solution, a bleach-fixing solution, a washing solution, and a stabilizer.

The coloring stain has the following four main causes. The first cause is heat and humidity before a non-processed light-sensitive material is processed after its manufacture. The second cause is developing fog of a silver halide. The third cause is formation of a dye when a developing agent left in an emulsion layer is oxidized with oxygen or the like present in a bleach bath or air and then reacts with a coupler (e.g., a bleach stain). The fourth cause is deterioration with time of the developed light-sensitive material, which is caused by light, humidity, and heat after development processing.

The coloring stain which is dealt with the present invention corresponds to the third and/or fourth stains. The former stain is called "stain upon processing", and the latter stain is called "stain during storage".

In a silver halide color photographic light-sensitive material, a stain formed in a non-exposed portion determines the presence/absence of clearing of an image. In addition, color mixing of a dye image is increased, and visual sharpness is degraded. In particular, when the light-sensitive material is used as a reflecting material (e.g., color paper or reversal color paper), the reflecting density of the stain is emphasized several times the transmission density, and image quality is degraded even by a slight stain. Formation of the stains thus poses a very important problem.

It is very difficult to sufficiently prevent a stain from forming in a non-exposed portion (stain during storage) by development processing unlike a so-called yellow stain caused when a coupler itself is decomposed by light or heat, although a discoloration inhibitor such as hydroquinones, hindered phenols, tocopherols, chromans, and coumarans is used.

On the other hand, a 2-equivalent 5-pyrazolone type magenta coupler is used together with a specific aniline compound to prevent this coloring stain (stain during storage), as proposed in U.S. Pat. No. 4,483,919. Use of a compound which reacts with a developing agent left in the developed light-sensitive material or an oxidized form of the developing agent for forming a dye upon coupling with a coupler to produce a substantially colorless product is proposed in EPO Nos. 255,722, 258,662, 2,287,655, and 230,048 and U.S. Pat. No. 4,704,350. In particular, even a slight magenta coloring stain is visually noticeable, and must be eliminated. When recording and preservation as the main purpose of the light-sensitive material are taken into consideration, strong demand has arisen for image preservation against light, heat, and humidity and prevention of formation of a magenta coloring stain. However, the conventional inhibitors as described above are not suitable for long-term preservation. The stains upon processing are not effectively prevented by the above methods.

An improvement in prevention of a cyan stain during storage is described in JP-A-62-173466 ("JP-A-" means unexamined published Japanese Patent Application). This specification describes a method of reducing the stain during storage by adding a specific compound to a cyan coupler. The effect, however, is not satisfactory. In addition, no effect is obtained for the stain upon processing.

In recent years, in order to satisfy the customer needs and protect natural environments, a stain upon processing and a stain during storage must be suppressed in development having a short developing time, i.e., so-called fast development, development in which processing solutions containing almost no benzylalcohol are used, processing requiring no or almost no washing, and processing using a processing solution in which the mixing ratio and the composition amount in the running condition are greatly changed.

SUMMARY OF THE INVENTION

It is an object of the present invention to provide a silver halide color photographic light-sensitive material in which a stain upon processing and a stain during storage are reduced.

In order to achieve the above object of the present invention, there is provided a silver halide color photographic light-sensitive material comprising at least one red-sensitive silver halide emulsion layer, at least one green-sensitive silver halide emulsion layer, and at least one blue-sensitive silver halide emulsion layer, which are formed on a support, wherein the blue-sensitive silver halide emulsion layer contains at least one acylacetamide type yellow dye-forming coupler represented by formula (I), and the red-sensitive silver halide emulsion layer contains at least one cyan coupler represented by formula (II) or (III):

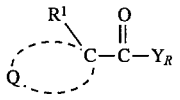

(I)

where $R^1$ represents a monovalent group, Q represents a nonmetallic atomic group required to form, together with C, a 3- to 5-membered carbocyclic ring or a 3- to 5-membered heterocyclic ring containing at least one heteroatom selected from the group consisting of N, S, O, and P in the ring, $R^1$ being not hydrogen and not combined with Q to form a ring, and $Y_R$ represents a residue remaining after removing the acyl group:

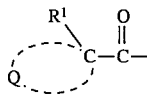

(I')

from the acylacetamide type yellow dye-forming coupler;

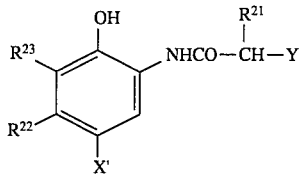

(II)

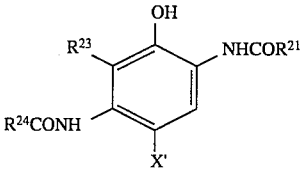

(III)

where $R^{21}$ represents an alkyl group, an aryl group, or a heterocyclic group, $R^{22}$ represents an alkyl group having 2 or more carbon atoms, $R^{23}$ represents a hydrogen atom, a halogen atom, an alkyl group, an aryl group, an alkoxy group, an aryloxy group, a carbonamido group, or a ureido group, $R^{24}$ represents an alkyl group, an aryl group, a heterocyclic group, an alkoxy group, an aryloxy group, or an amino group, X' represents a hydrogen atom or a coupling split-off group, and Y represents an alky group or an aryloxy group.

The present inventors made studies and found that stains upon processing and during storage were associated with the types of couplers contained in stain-generated layers and with couplers contained in layers except for the stain-generated layers. More specifically, it was also found that the stain upon processing mainly depended on the types of couplers contained in light-sensitive and light-non-sensitive layers closer to the support than the stain-generated layer, and that the stain during storage mainly depended on the types of couplers contained in light-sensitive and light-non-sensitive layers farther to the support than the stain-generated layer. The present inventors made further studies on various couplers of the respective layers to achieve the object of the present invention and found that the object of the present invention could be achieved by the above silver halide color photographic light-sensitive material.

Additional objects and advantages of the invention will be set forth in the description which follows, and in part will be obvious from the description, or may be learned by practice of the invention. The objects and advantages of the invention may be realized and obtained by means of the instrumentalities and combinations particularly pointed out in the appended claims.

Detailed Description of the Preferred Embodiments

The present invention will be described in detail below.

An acylacetamide type yellow dye-forming coupler represented by formula (I) and contained in the light-sensitive material according to the present invention is preferably a compound represented by formula (Y) given below:

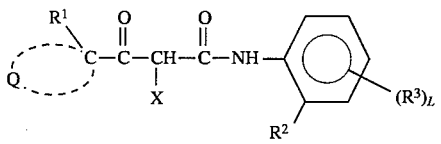

Formula (Y)

wherein $R^1$ represents a monovalent group except for hydrogen, Q represents a nonmetallic atomic group required to form, together with C, a 3- to 5-memhered carbocyclic ring or a 3- to 5-membered heterocyclic ring containing at least one heteroatom selected from N, S, O, and P in the ring, $R^2$ represents a hydrogen atom, a halogen atom (e.g., F, Cl, Br, or I; this will be the same in explanation of formula (Y) hereinafter), an alkoxy group, an aryloxy group, an alkyl group, or an amino group, $R^3$ represents a group which can be substituted on the benzene ring, X represents a hydrogen atom or a group (to be referred to as a split-off group hereinafter) which can be split off upon a coupling reaction with an oxidized form of an aromatic primary amine developing agent, and L represents an integer from 0 to 4. If L represents a plural number, a plurality of $R^3$'s may be the same or different.

Examples of $R^3$ are a halogen atom, an alkyl group, an aryl group, an alkoxy group, an aryloxy group, an alkoxycarbonyl group, an aryloxycarbonyl group, a carbonamido group, a sulfonamido group, a carbamoyl group, a sulfamoyl group, an alkylsulfonyl group, a ureido group, a sulfamoylamino group, an alkoxycarbonylamino group, an alkoxysulfonyl group, an acyloxy group, nitro, a heterocyclic group, cyano, an acyl group, an alkylsulfonyloxy group, and an arylsulfonyloxy group.

Examples of the split-off group are a heterocyclic group, which combine with a coupling active site by nitrogen, an aryloxy group, an arylthio group, an acyloxy group, an alkylsulfonyloxy group, an arylsulfonyloxy group, a heterocyclic oxy group, and a halogen atom.

If the group in formula (Y) is an alkyl group or contains an alkyl group, this alkyl group means, unless defined otherwise, a straight-chain, branched, or cyclic alkyl group which may be substituted and may contain an unsaturated bond. Examples of the alkyl group are methyl, isopropyl, t-butyl, cyclopentyl, t-pentyl, cyclohexyl, 2-ethylhexyl, 1,1,3,3-tetramethylbutyl, dodecyl, hexadecyl, allyl, 3-cyclohexenyl, oleyl, benzyl, trifluoromethyl, hydroxymethyl-methoxyethyl, ethoxycarbonylmethyl, and phenoxyethyl.

If the group in formula (Y) is an aryl group or contains an aryl group, this aryl group means a monocyclic or condensed-ring aryl group, unless defined otherwise. Examples of this aryl group are phenyl, 1-naphthyl, p-tolyl, o-tolyl, p-chlorophenyl, 4-methoxyphenyl, 8-quinolyl, 4-hexadecyloxyphenyl, pentafluorophenyl, p-hydroxyphenyl, p-cyanophenyl, 3-pentadecylphenyl, 2,4-di-t-pentylphenyl, p-methanesulfonamidephenyl, and 3,4-dichlorophenyl.

If the group in formula (Y) is a heterocyclic group or contains a heterocyclic group, this heterocyclic group means a 3- to 8-membered monocyclic or condensed-ring heterocyclic group which contains at least one heteroatom selected from O, N, S, P, Se, and Te in its ring and may be substituted, unless defined otherwise. Examples of the heterocyclic group are 2-furyl, 2-pyridyl, 4-pyridyl, 1-pyrazolyl, 1-imidazolyl, 1-benzotriazolyl, 2-benzotriazolyl, succinimido, phthalimido, and 1-benzyl-2,4-imidazolidinedione-3-yl.

Preferable groups in formula (Y) will be described below.

In formula (Y), $R^1$ is preferably a halogen atom, a cyano group, or a monovalent group (e.g., an alkyl group or an alkoxy group) having 1 to 30 carbon atoms or a monovalent group (e.g., an aryl group or an aryloxy group) having 6 to 30 carbon atoms. Each of the monovalent groups may be substituted. Examples of the substituent are a halogen atom, an alkyl group, an alkoxy group, nitro, an amino group, a carbonamido group, a sulfonamido group, and an acyl group.

In formula (Y), Q preferably represents a nonmetallic atomic group required to form, together with C, a 3- to 5-membered carbocyclic ring which has 3 to 30 carbon atoms and may be substituted, or a 3- to 5-membered heterocyclic group which contains at least one heteroatom selected from N, S, O, and P, has 2 to 30 carbon atoms, and may be substituted. The ring that Q forms together with C may contain an unsaturated bond in it.

Examples of the ring formed by Q combined with C are cyclopropane, cyclobutane, cyclopentane, cyclopropene, cyclobutene, cyclopentene, oxetane, oxolane, 1,3-dioxolane, thiethane, thiolane, and pyrrolidine rings. If Q is substituted, examples of the substituent are a halogen atom, hydroxyl, an alkyl group, an aryl group, an acyl group, an alkoxy group, an aryloxy group, cyano, an alkoxycarbonyl group, an alkylthio group, and an arylthio group.

In formula (Y), $R^2$ preferably represents a halogen atom, an alkoxy group having 1 to 30 carbon atoms, an aryloxy group having 6 to 30 carbon atoms, an alkyl group having 1 to 30 carbon atoms, or an amino group having 0 to 30 carbon atoms, each of which may be substituted. Examples of the substituent are a halogen atom, an alkyl group, an alkoxy group, and an aryloxy group.

In formula (Y), $R^3$ preferably represents a halogen atom, or an alkyl group having 1 to 30 carbon atoms, an aryl group having 6 to 30 carbon atoms, an alkoxy group having 1 to 30 carbon atoms, an alkoxycarbonyl group having 2 to 30 carbon atoms, an aryloxycarbonyl group having 7 to 30 carbon atoms, a carbonamido group having 1 to 30 carbon atoms, a sulfonamido group having 1 to 30 carbon atoms, a carbamoyl group having 1 to 30 carbon atoms, a sulfamoyl group having 0 to 30 carbon atoms, an alkylsulfonyl group having 1 to 30 carbon atoms, an arylsulfonyl group having 6 to 30 carbon atoms, an ureido group having 1 to 30 carbon atoms, a sulfamoylamino group having 0 to 30 carbon atoms, an alkoxycarbonylamino group having 2 to 30 carbon atoms, a heterocyclic group having 1 to 30, an acyl group having 1 to 30 carbon atoms, an alkylsulfonyloxy group having 1 to 30 carbon atoms, or an arylsulfonyloxy group having 6 to 30 carbon atoms, each of which may be substituted. Examples of the substituent are a halogen atom, an alkyl group, an aryl group, a heterocyclic group, an alkoxy group, an aryloxy group, a heterocyclicoxy group, an alkylthio group, an arylthio group, a heterocyclicthio group, an alkylsulfonyl group, an arylsulfonyl group, an acyl group, a carbonamido group, a sulfonamido group, a carbamoyl group, a sulfamoyl group, an alkoxycarbonylamino group, a sulfamoylamino group, a ureido group, cyano, nitro, an acyloxy group, an alkoxycarbonyl group, an aryloxycarbonyl group, an alkylsulfonyloxy group, and an arylsulfonyloxy group.

The position of $R^3$ on the benzene ring in formula (Y) is preferably a meta or para position with respect to the group represented by the following formula:

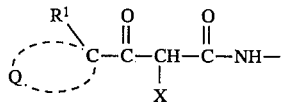

In formula (Y), L preferably represents an integer of 1 or 2.

In formula (Y), X preferably represents a heterocyclic group, which combines with a coupling active site through nitrogen, or an aryloxy group.

When X represents a heterocyclic group, X is preferably a 5- to 7-membered monocyclic or condensed-ring heterocyclic group. Examples of this heterocyclic group are succinimide, maleimide, phthalimide, diglycolimide, pyrrole, pyrazole, imidazole, 1,2,4-triazole, tetrazole, indole, indazole, benzimidazole, benzotriazole, imidazolidine-2,4-dione, oxazolidine-2,4-dione, thiazolidine-2,4-dione, imidazolidine-2-one, oxazolidine-2-one, thiazolidine 2-one, benzimidazolidine-2-one, benzoxazoline-2-one, benzothiazoline-2-one, 2-pyrroline-5-one, 2-imidazoline-5-one, indoline-2,3-dione, 2,6-dioxypurine, parabanic acid, 1,2,4-triazolidine-3,5-dione, 2-pyridone, 4-pyridone, 2-pyrimidone, 6-pyridazone-2-pyrazone, 2-amino-1,3,4-thiazolidine, and 2-imino-1,3,4-thiazolidine-4-one.

These heterocyclic rings may be substituted. Examples of the substituent are a halogen atom, hydroxyl, nitro, cyano, carboxyl, a sulfo group, an alkyl group, an aryl group, an alkoxy group, an aryloxy group, an alkylthio group, an arylthio group, an alkylsulfonyl group, an arylsulfonyl group, an alkoxycarbonyl group, an amino group, a carbonamido group, a sulfonamido group, a carbamoyl group, a sulfamoyl group, a ureido group, an alkoxycarbonylamino group, and a sulfamoylamino group.

When X represents an aryloxy group, it is preferably an aryloxy group having 6 to 30 carbon atoms, and may be substituted with a group selected from the substituents enumerated above as substituents when X represents a heterocyclic ring. Preferable examples of the substituent for the aryloxy group are a halogen atom, cyano, nitro, carboxyl, a trifluoromethyl group, an alkoxycarbonyl group, a carbonamido group, a sulfonamido group, a carbamoyl group, a sulfamoyl group, an alkylsulfonyl group, and an arylsulfonyl group.

Particularly preferable groups in formula (Y) will be described below.

In formula (Y), $R^1$ is particularly preferably a halogen atom or an alkyl group, more preferably an alkyl group having 2 to 20 carbon atoms, and most preferably ethyl, n-propyl, n-butyl or benzyl.

In formula (Y), Q is particularly preferably a nonmetallic atomic group required to form, together with C, a 3- to 5-membered carbocyclic ring, for example, $—(CR_2)_2—$, $—(CR_2)_3—$, or $—(CR_2)_4—$, wherein R represents a hydrogen atom, a halogen atom, or an alkyl group. Note that a plurality of R's and $CR_2$'s may be the same or different. Q is most preferably $—(CR_2)_2—$ which forms a 3-membered ring together with C combined to Q.

In formula (Y), $R^2$ is particularly preferably chlorine, fluorine, an alkyl group (e.g., methyl, trifluoromethyl, ethyl, isopropyl, and t-butyl) having 1 to 6 carbon atoms, an alkoxy group (e.g., methoxy, ethoxy, methoxyethoxy, and butoxy) having 1 to 8 carbon atoms, or an aryloxy group (e.g., phenoxy group, p-tolyloxy, and p-methoxyphenoxy) having 6 to 24 carbon atoms, and most preferably chlorine, methoxy, or trifluoromethyl.

In formula (Y), $R^3$ is particularly preferably a halogen atom, an alkoxy group, an alkoxycarbonyl group, an aryloxycarbonyl group, a carbonamido group, a sulfonamido group, a carbamoyl group, or a sulfamoyl group, and most preferably an alkoxy group, an alkoxycarbonyl group, a carbonamido group, or a sulfonamido group.

In formula (Y), X is particularly preferably a group represented by formula (Y-A), (Y-B), or (Y-C) below: (Y-A):

(Y-A):

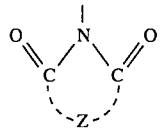

(Y-B):

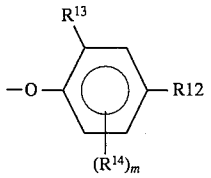

(Y-C):

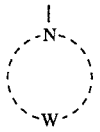

In formula (Y-A), Z represents —O—$CR^4(R^5)$—, —S—$CR^4(R^5)$—, —$NR^6$—$CR^4(R^5)$—, $NR^6$—$NR^7$—, —$NR^6$—C(O)—, —$CR^4(R^5)$—$CR^8(R^9)$—, or —$CR^{10}$=$CR^{11}$—.

Each of $R^4$, $R^5$, $R^8$, and $R^9$ represents a hydrogen atom, an alkyl group, an aryl group, an alkoxy group, an aryloxy group, an alkylthio group, an arylthio group, an alkylsulfonyl group, an arylsulfonyl group, or an amino group. Each of $R^6$ and $R^7$ represents a hydrogen atom, an alkyl group, an aryl group, an alkylsulfonyl group, an arylsulfonyl group, or an alkoxycarbonyl group. Each of $R^{10}$ and $R^{11}$ represents a hydrogen atom, an alkyl group, or an aryl group. $R^{10}$ and $R^{11}$ may combine together to form a benzene ring. $R^4$ and $R^5$, $R^5$ and $R^6$, $R^6$ and $R^7$, or $R^4$ and $R^8$ may combine together to form a ring. Example of the ring are cyclobutane, cyclohexane, cycloheptane, cyclohexene, pyrrolidine, or pyperidine.

The most preferable example of the heterocyclic group represented by formula (Y-A) is a heterocyclic group in which Z is —O—$CR^4(R^5)$—, —$NR^6$—$CR^4(R^5)$—, or —$NR^6$—$NR^7$— in formula (Y-A).

The heterocyclic group represented by formula (Y-A) has 2 to 30, preferably 4 to 20, and more preferably 5 to 16 carbon atoms.

In formula (Y-B), at least one of $R^{12}$ and $R^{13}$ may be a group selected from a halogen atom, cyano, nitro, trifluoromethyl, carboxyl, an alkoxycarbonyl group, a carbonamido group, a sulfonamido group, a carbamoyl group, a sulfamoyl group, an alkylsulfonyl group, an arylsulfonyl group, and an acyl group, and the other may also be a hydrogen atom, an alkyl group, or an alkoxy group. $R^{14}$ represents a group of the same meaning as $R^{12}$ or $R^{13}$, and m represents an integer of 0 to 2.

The aryloxy group represented by formula (Y-B) has 6 to 30, preferably 6 to 24, and more preferably 6 to 15 carbon atoms.

In formula (Y-C), W represents a nonmetallic atomic group required to form, together with N, a pyrrole, pyrazole, imidazole, or triazole ring. The ring may have a substituent. Preferable examples of the substituent are a halogen atom, nitro, cyano, alkoxycarbonyl group, an alkyl group, an aryl group, an amino group, an alkoxy group, an aryloxy group, or carbamoyl group.

The heterocyclic group represented by (Y-C) has 2 to 30, preferably 2 to 24, and more preferably 2 to 16 carbon atoms.

In formula (Y), X is most preferably a group represented by formula (Y-A).

A coupler represented by formula (Y) may form dimers or polymers having a higher degree of polymerizatioin, which combine together through a divalent group or a polyvalent group, at the group $R^1$, Q, X, or the following group:

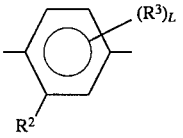

In this case, the number of carbon atoms described above in each substituent may fall outside the defined range.

Practical examples of each group in formula (Y) and examples of the compound of formula (Y) will be listed below.

(1) Examples of a group 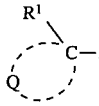 , which $R^1$ and Q form together with C

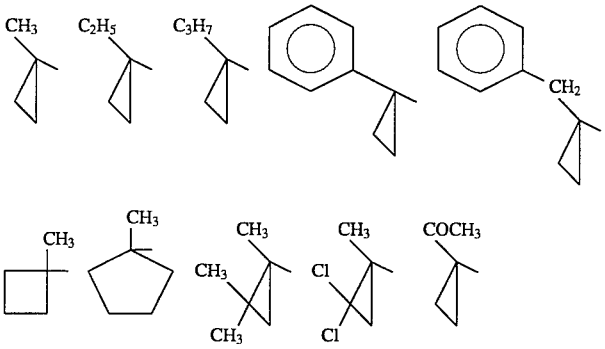

-continued
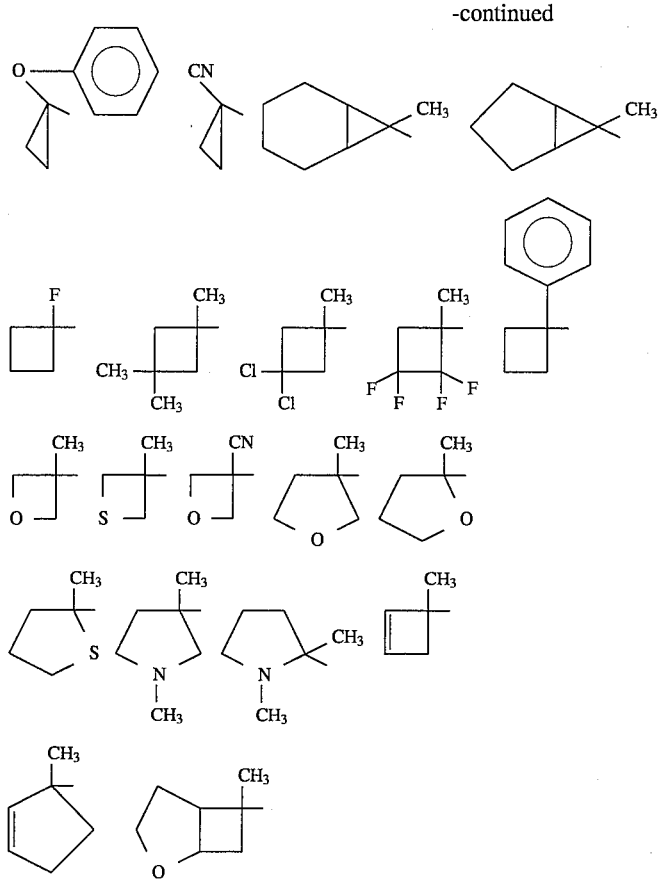
(2) Examples of $R^2$
F, Cl, Br, I, $CH_3O$—, 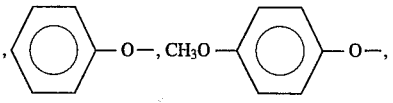 —O—, $CH_3O$—  —O—,
$CH_3$—, $C_2H_5$—, i-$C_3H_7$—, t-$C_4H_9$—, $CH_3OCH_2CH_2O$—,
$CF_3$—, $(CH_3)_2N$—, 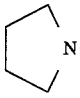 N—, n-$C_4H_9O$—,
n-$C_{14}H_{29}O$—, n-$C_{16}H_{33}O$—, 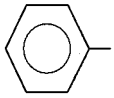 —$CH_2O$—, n-$C_{12}H_{25}O$—
(3) Examples of $R^3$
F, Cl, Br, I, $CH_3O$—, $C_2H_5O$—, n-$C_{12}H_{25}O$—, $CH_3$, t-$C_4H_9$—, —$COOCH_3$, $COOC_2H_5$,
—$COOC_4H_9$-n, —$COOC_{12}H_{25}$-n, —$OCH_2CH(C_6H_{13}\text{-n})C_8H_{17}$-n
—$COOCH(CH_3)COOC_{12}H_{25}$-n, —$COOCH(C_4H_9\text{-n})COOC_{12}H_{29}$-n,
—COO— 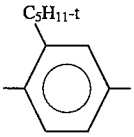 —$C_5H_{11}$-t, —$CONH(CH_2)_3O$— 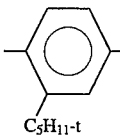 —$C_5H_{11}$-t -continued
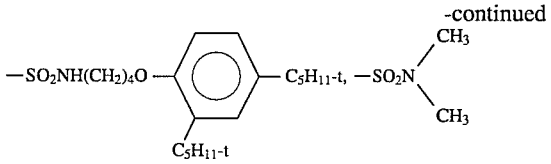
$-SO_2NHCOC_2H_5$, $-SO_2NHC_{16}H_{33}$-t,
$-NHCOC_{13}H_{27}$-n, $-NHCOC_{15}H_{33}$-n, $-NHCOC_{17}H_{35}$-n $-NHCOCH(C_6H_{13}\text{-n})-C_8H_{17}$-n,
$-NHCOCH(CHCH_2C_4H_9\text{-t})(CH_3)-CH_2CH_2CH(CH_3)CH_2C_4H_9$-t $-NHCOCH(CH_3)CH_2SO_2C_{16}H_{33}$-n
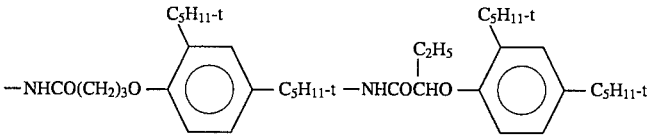
$-NHCOCH(C_3H_7\text{-i})SO_2C_{16}H_{33}$-n, $-NHSO_2C_{12}H_{25}$-n, $-NHSO_2C_{16}H_{33}$-n,
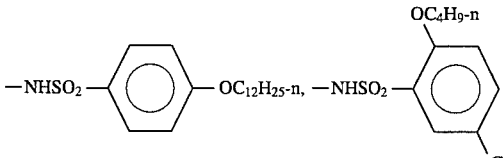
, $-SO_2NHCH_3$,
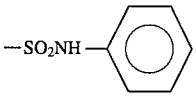
, $-OCOC_{11}H_{23}$-n, $-OSO_2C_{12}H_{25}$-n, $-NHCOOC_{12}H_{25}$-n,
(4) Examples of X
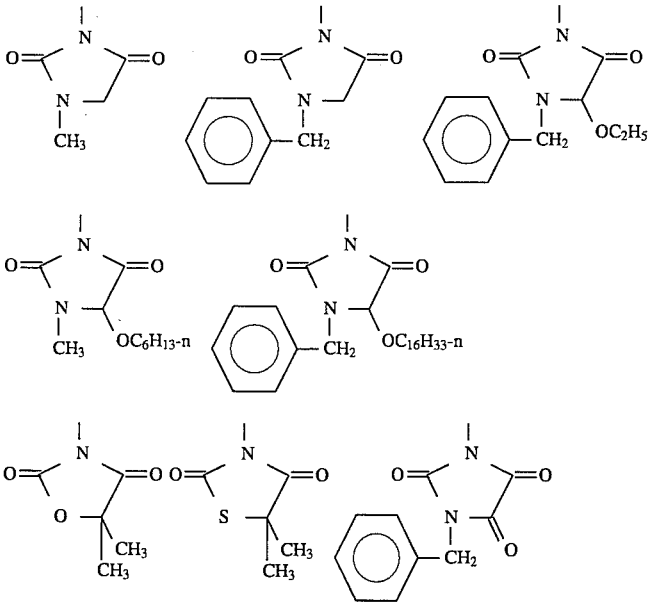

-continued
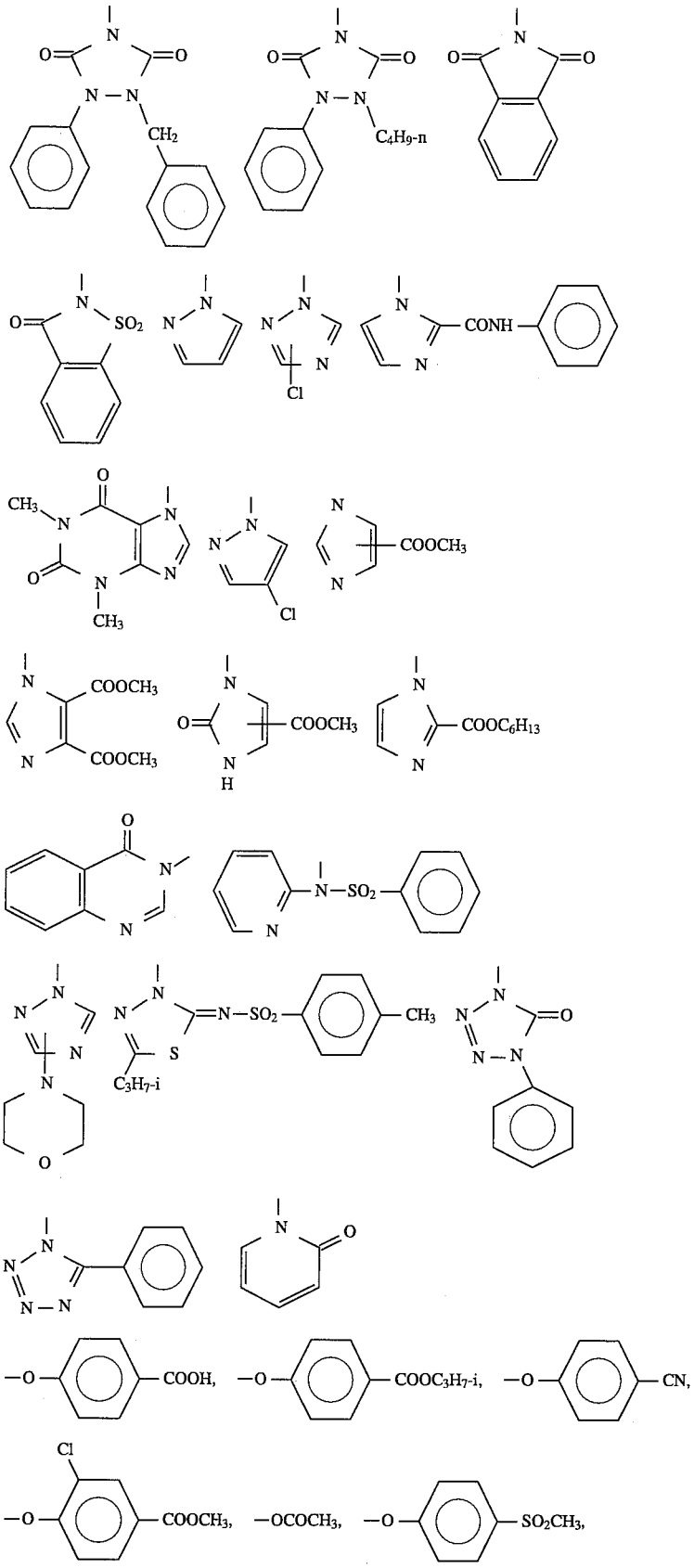

-continued
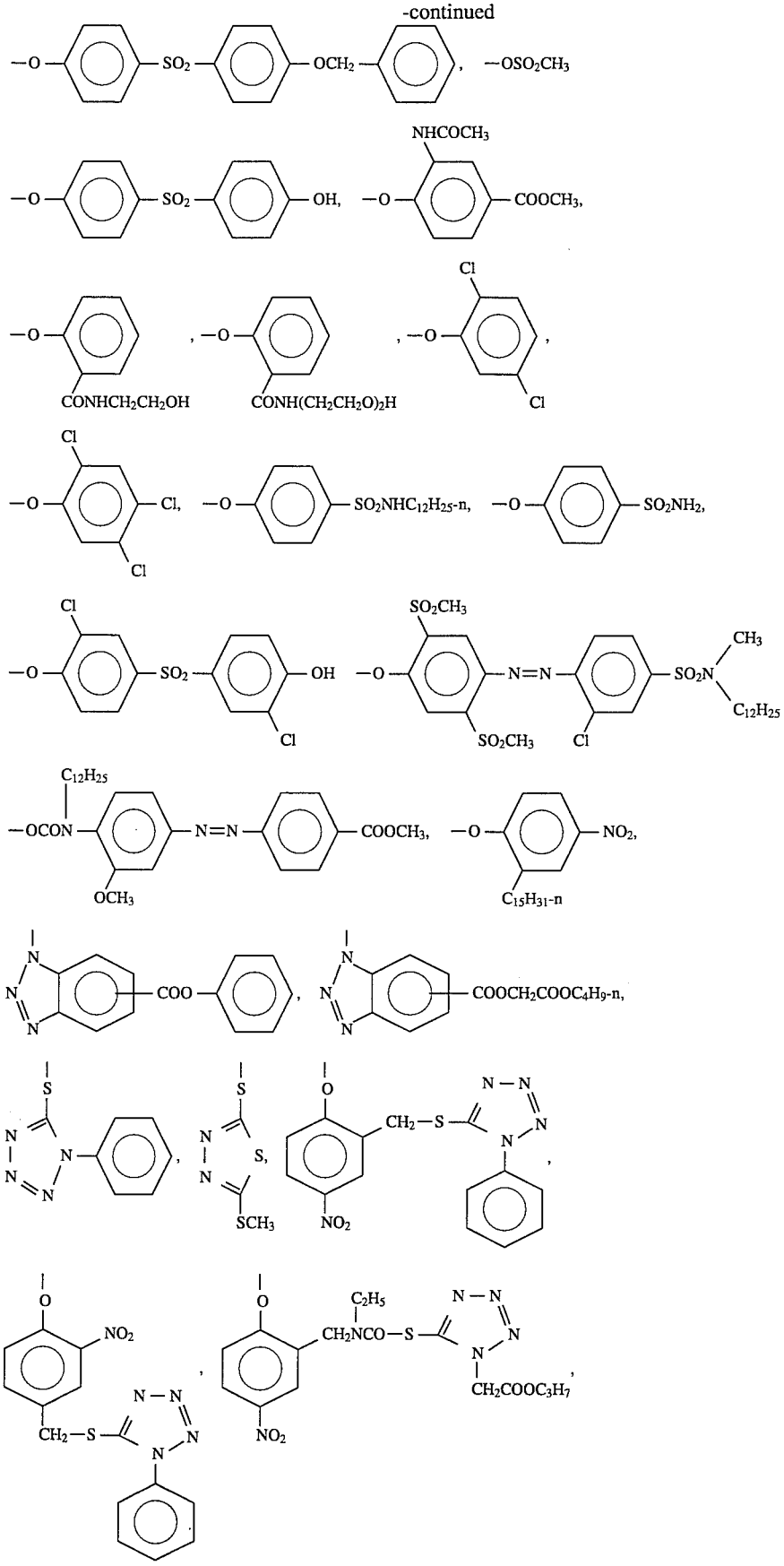

-continued
Practical examples Y-1 to Y-54 of a yellow coupler represented by formula (Y) will be presented below.
Y-1
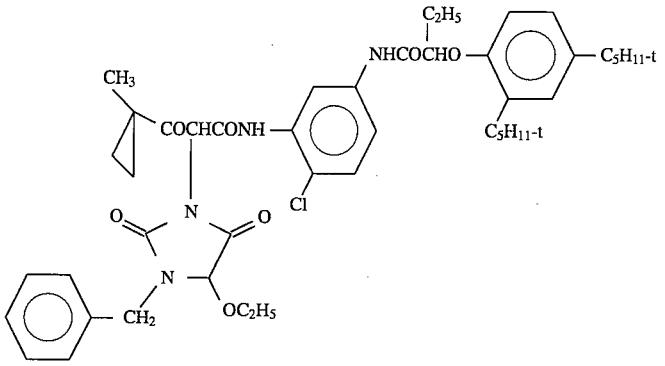
Y-2
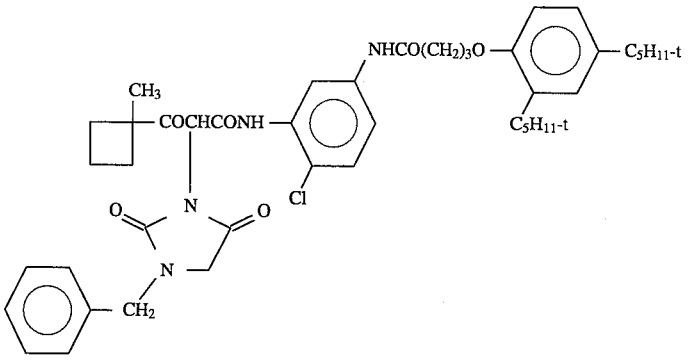
Y-3
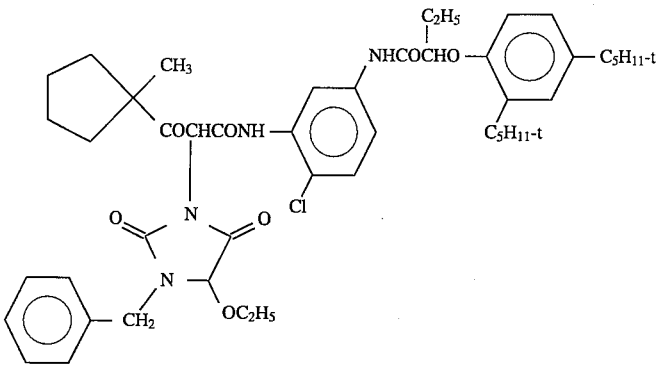
Y-4
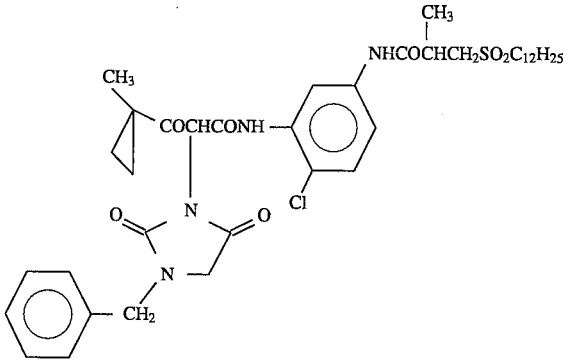

-continued
Y-5
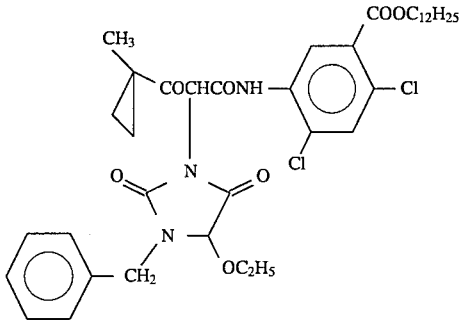
Y-6
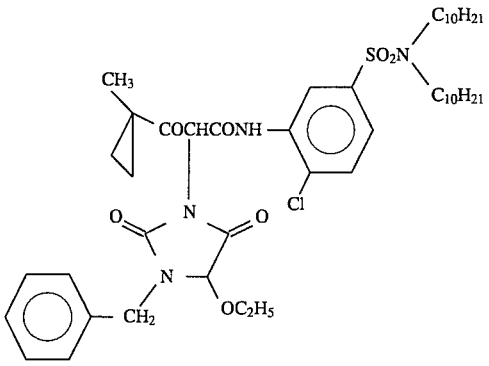
Y-7
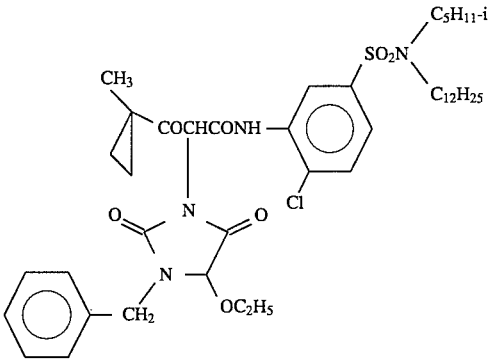
Y-8
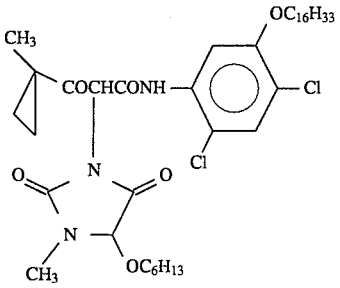

-continued
Y-9
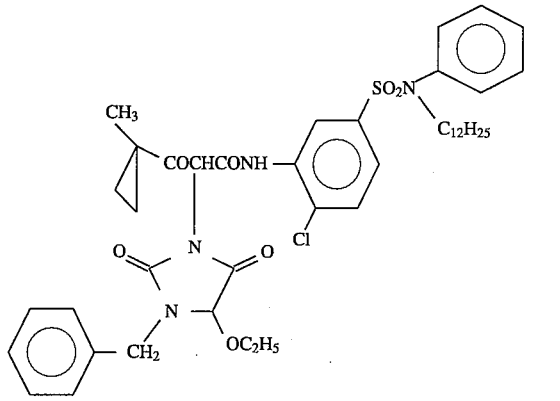
Y-10
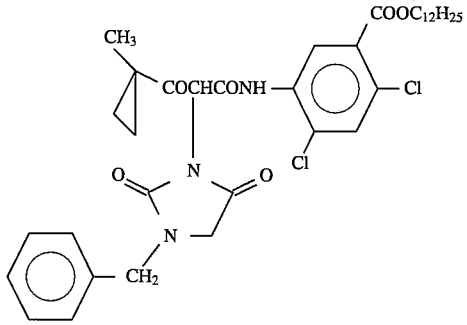
Y-11
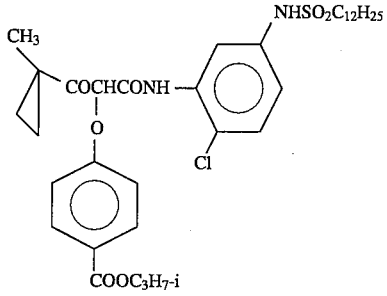
Y-12
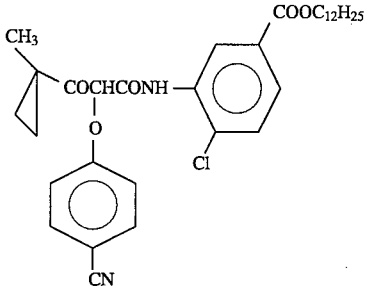
Y-13
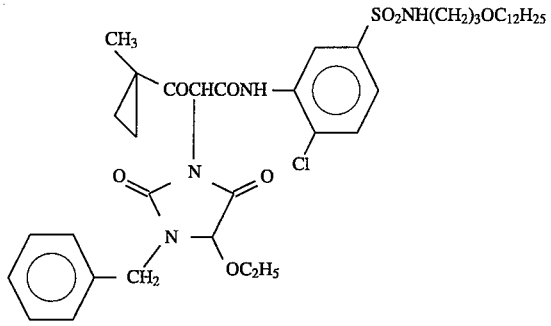

-continued
Y-14
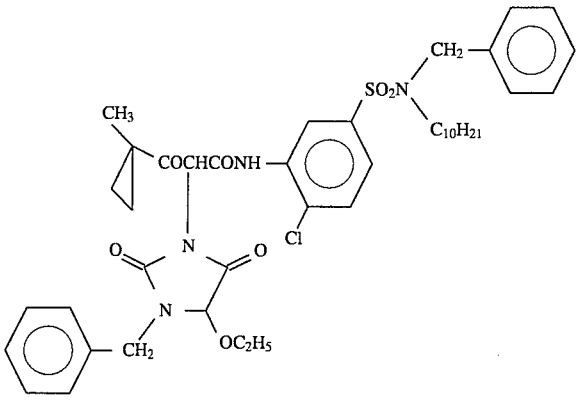
Y-15
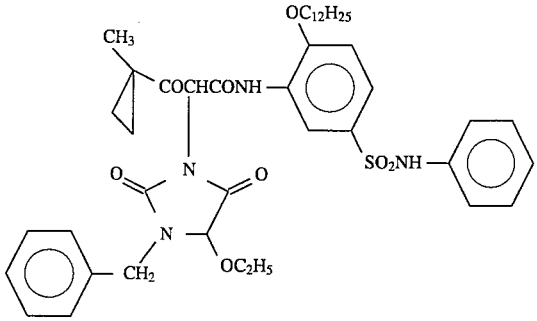
Y-16
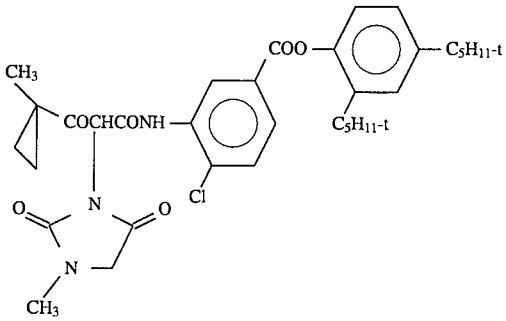
Y-17
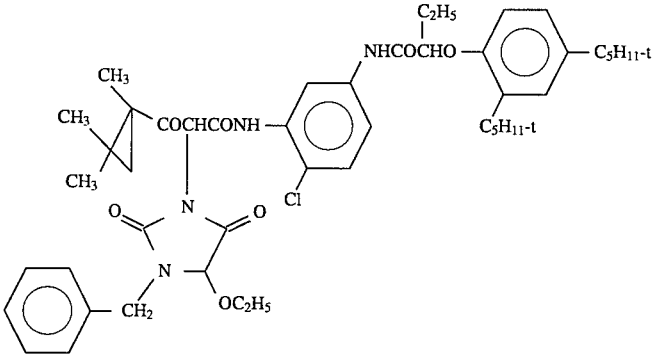

-continued
Y-18
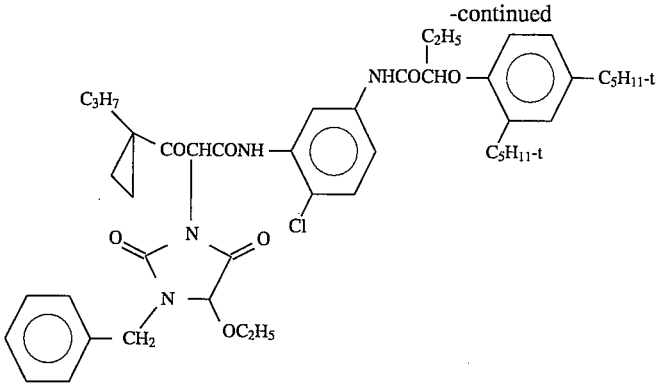
Y-19
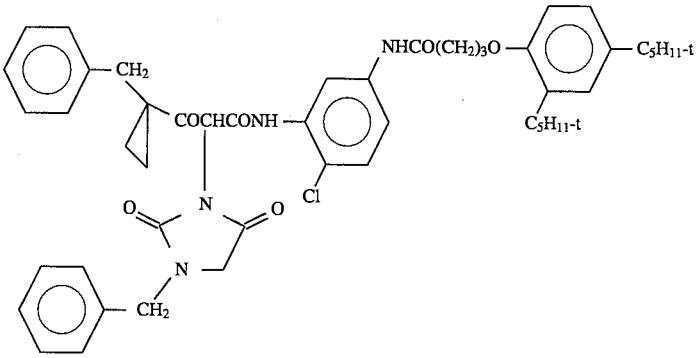
Y-20
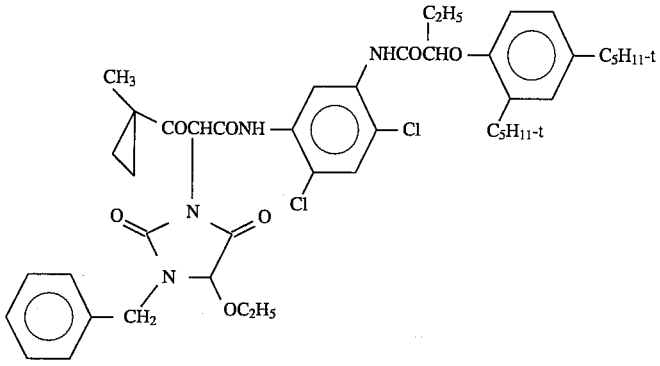
Y-21
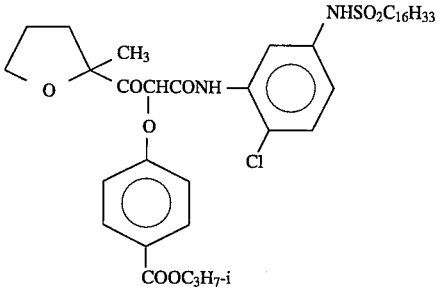

-continued
Y-22
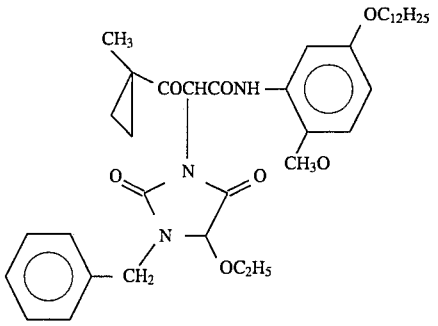
Y-23
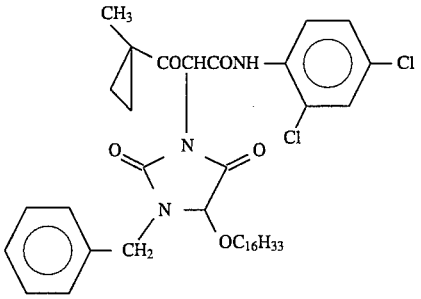
Y-24
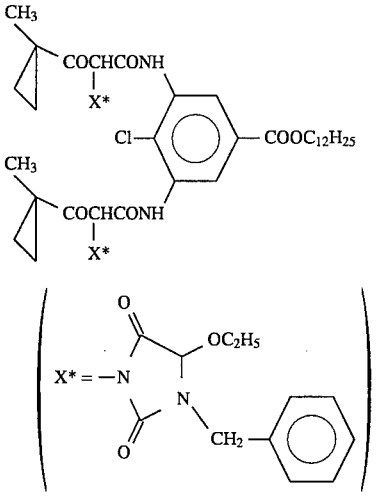
Y-25
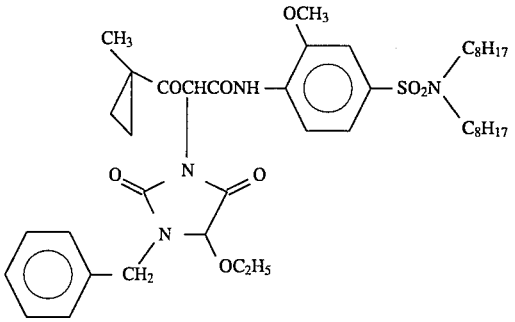

-continued
Y-26
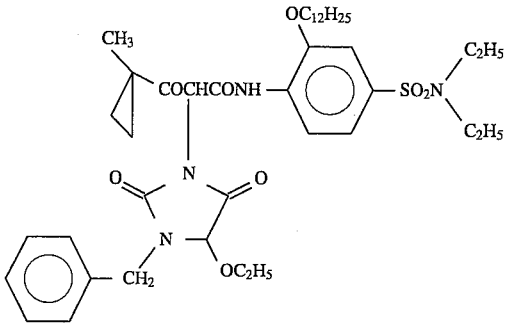
Y-27
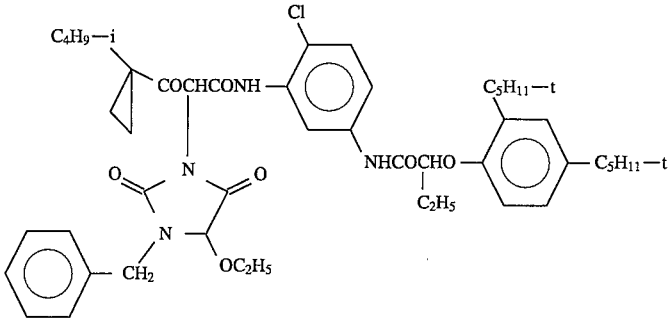
Y-28
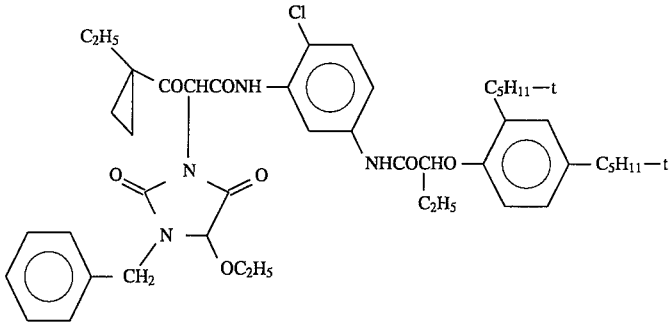
Y-29
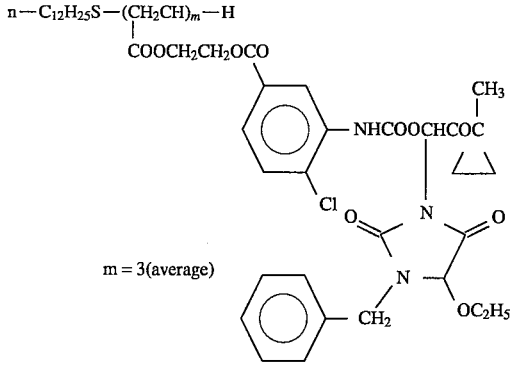
m = 3(average)
Y-30
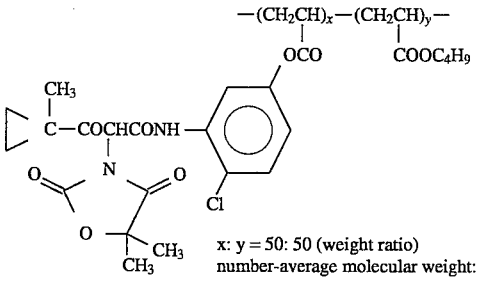
x: y = 50: 50 (weight ratio)
number-average molecular weight: 50,000

-continued
Y-31
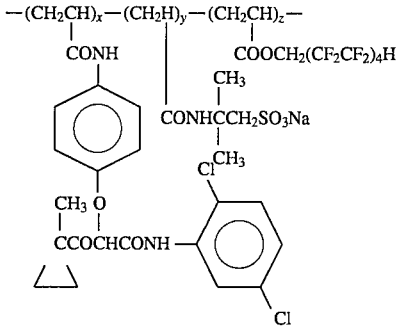
x : y : z = 50 : 30 : 20 (weight ratio)
number-average molecular weight: 70,000
Y-32
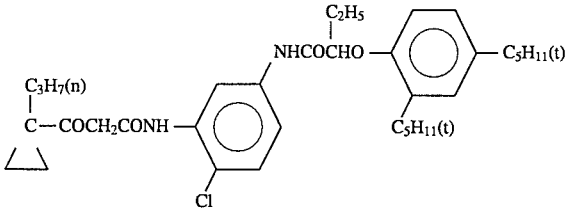
Y-33
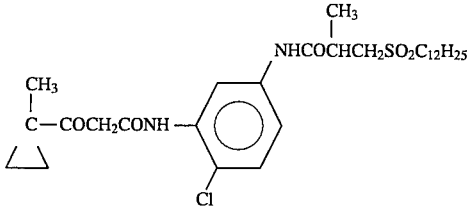
34
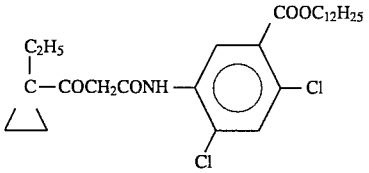
Y-35
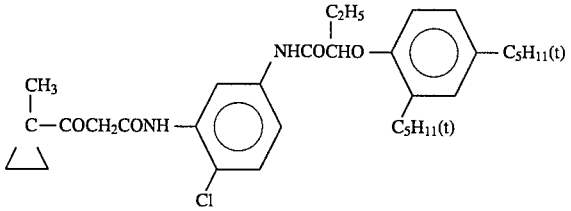
Y-36
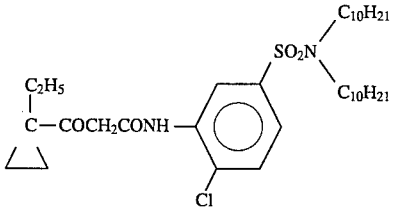
Y-37
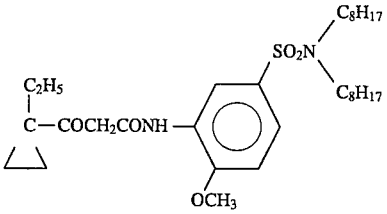

-continued
Y-38
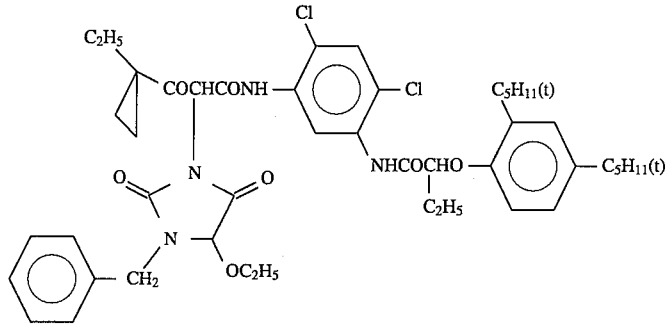
Y-39
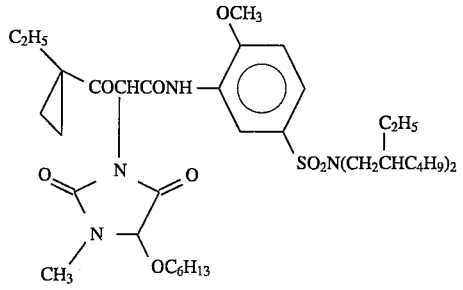
Y-40
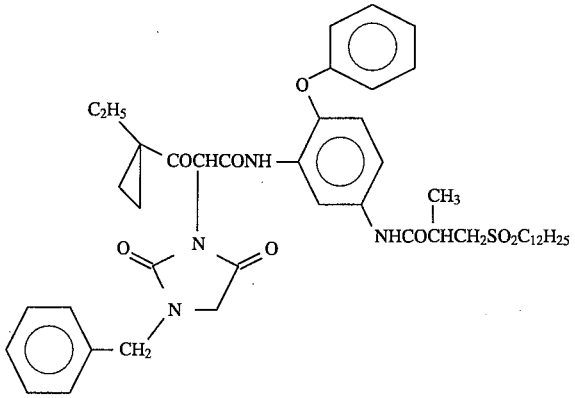
Y-41
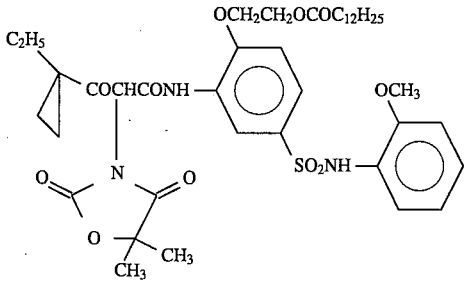
Y-42
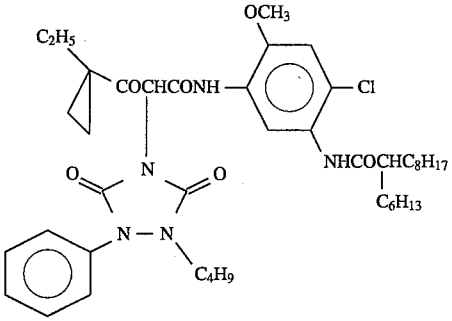

-continued
Y-43
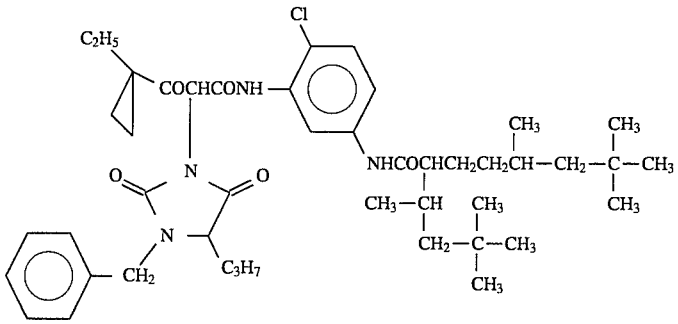
Y-44
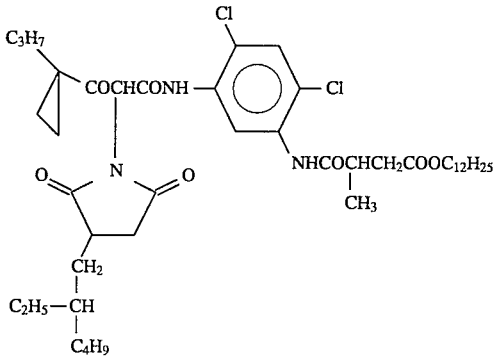
Y-45
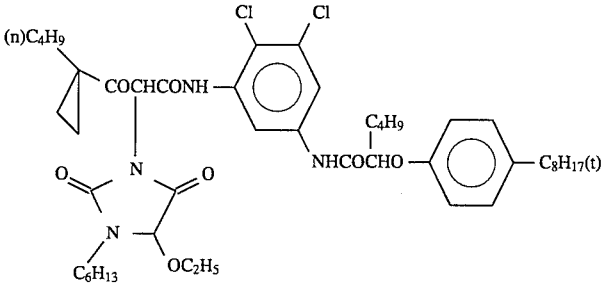
Y-46
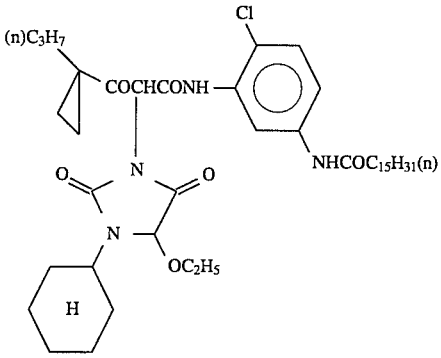
Y-47
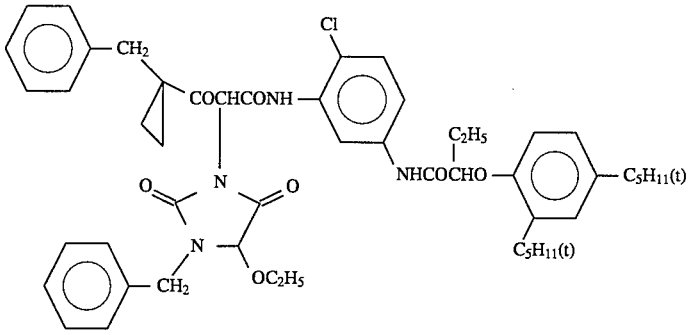

-continued
Y-48
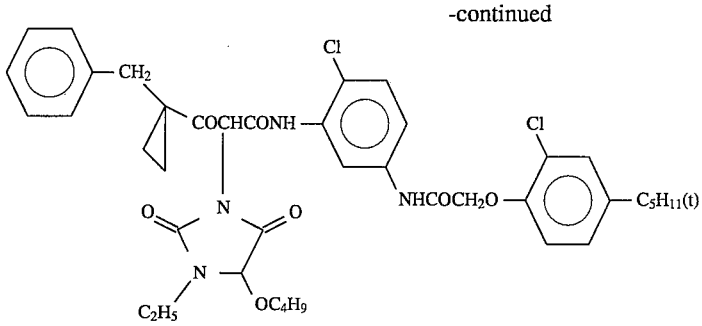
Y-49
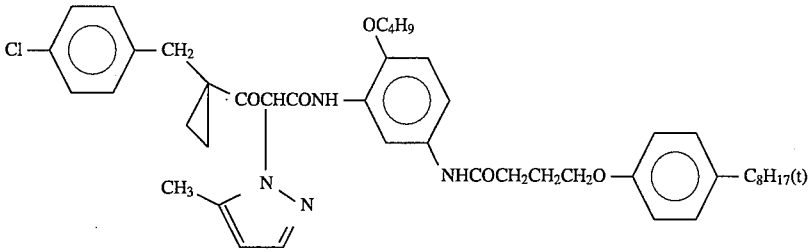
Y-50
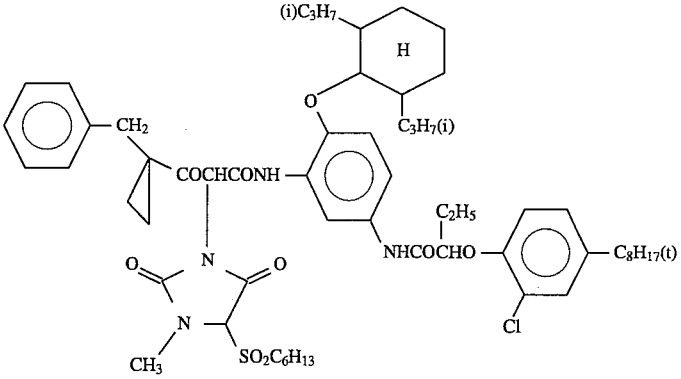
Y-51
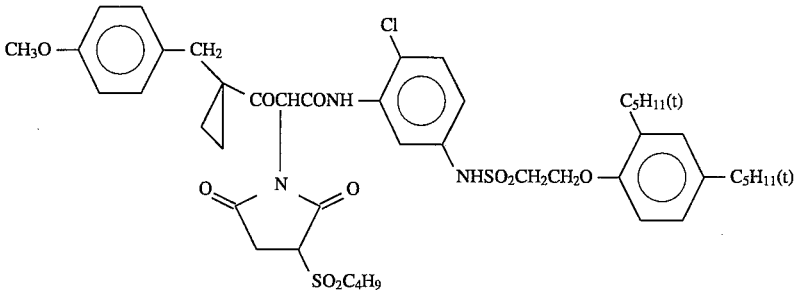
Y-52
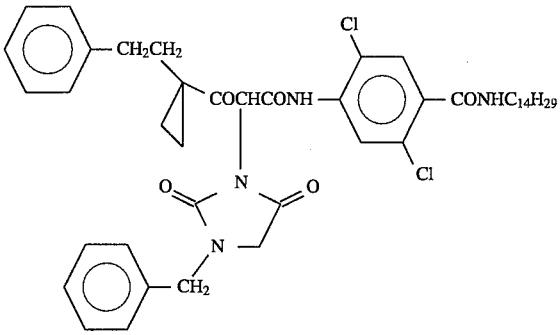

-continued

Y-53

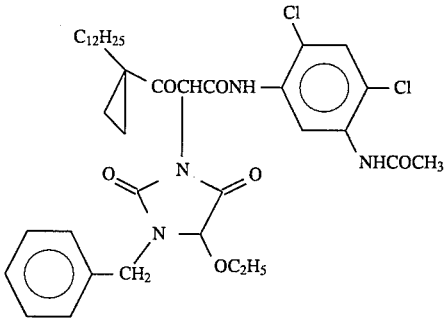

Y-54

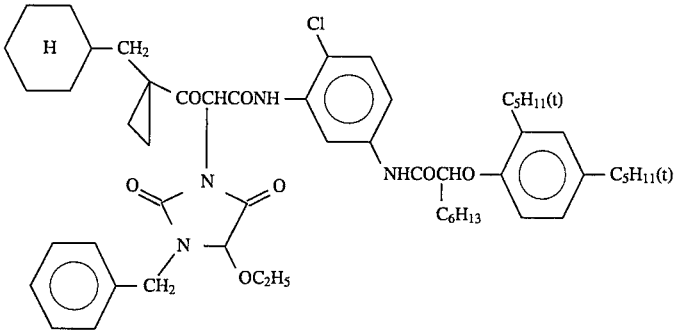

A yellow coupler represented by formula (Y) which is preferably used for the silver halide color photographic light-sensitive material of the present invention can be synthesized by the following synthesis route.

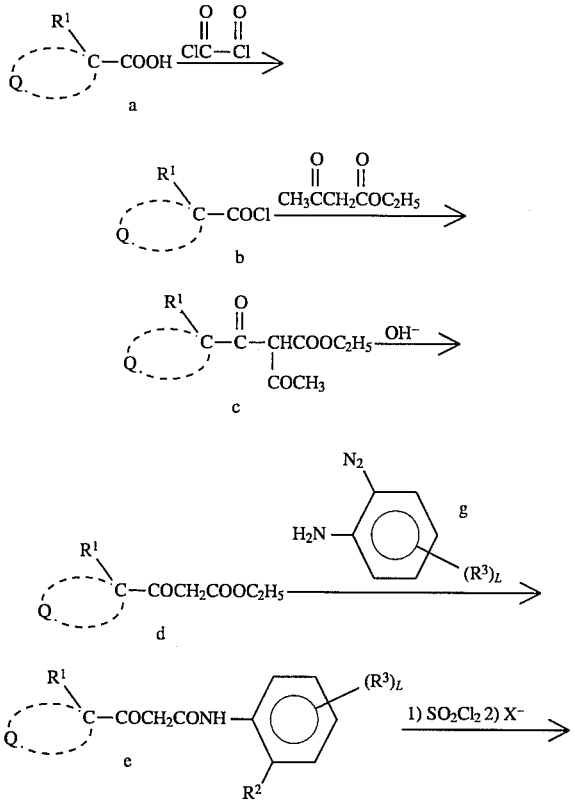

-continued

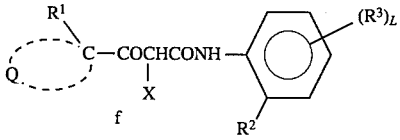

The compound a can be synthesized by methods described in, e.g., J. Chem. Soc. (C), 1968, 2548, J. Am. Chem. Soc. , 1934, 56, 2710, Synthesis, 1971, 258, J. Org. Chem., 1978, 43, 1729, CA, 1960, 66, 18533y.

In this synthesis route, the synthesis of the compound b can be performed by using, e.g., thionyl chloride or oxalyl chloride in the absence of a solvent or in a solvent such as methylene chloride, chloroform, carbon tetrachloride, dichloroethane, toluene, N,N-dimethylformamide, or N,N-dmethylacetamide. The reaction temperature is −20° C. to 150° C., and preferably −10° C. to 80° C.

In the synthesis route, the compound c can be synthesized by converting, e.g., ethyl acetoacetate into an anion by using magnesium methoxide and adding the compound b to the anion. The reaction can be performed in the absence of a solvent or in a solvent such as tetrahydrofuran or ethylether, and the reaction temperature is normally −20° C. to 60° C., and preferably −10° C. to 30° C.

In the synthesis route, the compound d can be synthesized by reacting the compound c with a base, such as an aqueous ammonia, an aqueous $NaHCO_3$ solution, or an aqueous sodium hydroxide solution, in the absence of a solvent or in a solvent such as methanol, ethanol, or acetonitrile. The reaction temperature is normally −20° C. to 50° C., and preferably −10° C. to 30° C.

In the synthesis route, the compound e can be synthesized by reacting the compounds d and g in the absence of a solvent. The reaction temperature is normally 100° C. to 150° C., and preferably 100° C. to 120° C. If X is not H, the split-off group X is introduced to finally synthesize the compound f after chlorination or bromination. The compound e is formed into a chloro-substitution compound by using. e.g., sulfuryl chloride or N-chlorosuccinimide or into a bromo-substituted compound bromo substitution by using, e.g., bromine or N-bromosuccinimide in a solvent such as dichloroethane, carbon tetrachloride, chloroform, methylene chloride, or tetrahydrofuran. At this time, the reaction temperature is −20° C. to 70° C., and preferably −10° C. to 50° C.

The coupler f contained in the silver halide color photographic light-sensitive material of the present invention can be obtained by reacting the chloro-substituted compound or the bromo-substituted compound of the compound e with a proton adduct H-X of a elimination group in a solvent such as methylene chloride, chloroform, tetrahydrofuran, acetone, acetonitrile, dioxane, N-methylpyrrolidone, N,N'-dimethylimidazolidine-2-one, N,N-dimethylformamide, or N,N-dimethylacetamide at a reaction temperature of −20° C. to 150° C., and preferably −10° C. to 100° C. At this time, it is possible to use a base such as triethylamine, N-ehylmorpholine, tetramethylguanidine, potassium carbonate, sodium hydroxide, or sodium hydrogencarbonate.

Synthesis examples of the couplers represented by formula (Y) according to the present invention will be described below.

Synthesis Example 1

(Synthesis of exemplified compound Y-35)

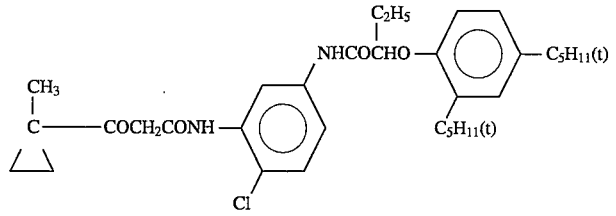

38.1 g of oxalylchloride are dropped in a mixture of 25 g of 1-methylcyclopropanecarboxylic acid synthesized by the method described in Gotkis, D. et. al., J. Am. Chem. Soc., 1934, 56, 2710, 100 ml of methylene chloride, and 1 ml of N,N-dimethylformamide, at room temperature over 30 minutes. After the dropping, the resultant mixture is reacted at room temperature for two hours, and the methylene chloride and an excess of oxalylchloride are removed under reduced pressure set by an aspirator. The result is an oily product of 1-methylcyclopropanecarbonylchloride.

100 ml of methanol are dropped in a mixture of 6 g of magnesium and 2 ml of carbon tetrachloride at room temperature over 30 minutes. The resultant mixture is heated under reflux for two hours, and 32.6 g of ethyl 3-oxobutyrate are dropped under heating and reflux over 30 minutes. After the dropping, the methanol is perfectly distilled off under reduced pressure set by an aspirator. 100 ml of tetrahydrofuran are dispersed in the reaction product, and the 1-methylcyclopropanecarbonylchloride obtained above is dropped at room temperature. After the reaction is continued for 30 minutes, the reaction solution is extracted with 300 ml of ethyl acetate and diluted sulfuric acid. The organic layer is washed with water and dried by sodium sulfate anhydride. Thereafter, the solvent is distilled off to obtain 55.3 g of an oily product of ethyl-2-(1-methylcyclopropanecarbonyl)-3-oxobutyrate.

A solution of 55 g of the ethyl-2-(1-methylcyclopropanecarbonyl)-3-oxobutyrate and 160 ml of ethanol is stirred at room temperature, and 60 ml of 30% aqueous ammonia are dropped in the solution over 10 minutes. The resultant solution is stirred for one hour and extracted with 300 ml of ethyl acetate and diluted hydrochloric acid. After neutralized and washed with water, the organic layer is dried by sodium sulfate anhydride, and the solvent is distilled off. The result is 43 g of an oily product of ethyl (1-methylcyclopropanecarbonyl)acetate.

34 g of the ethyl(i-methylcyclopropanecarbonyl) acetate acid and 44.5 g of N-(3-amino-4-chlorophenyl)-2-(2,4-di-t-pentylphenoxy)butaneamide are heated under reflux at an internal temperature of 100° C. to 120° C. under reduced pressure set by an aspirator. After the reaction is continued for four hours, the reaction solution is purified through a column chromatography using a solvent mixture of n-hexane and ethyl acetate to obtain 49 g of a viscous oily product of exemplified compound Y-35. The structure of the compound is confirmed by a MS spectrum, a NMR spectrum, and elemental analysis.

Synthesis Example 2

(Synthesis of exemplified compound Y-1)

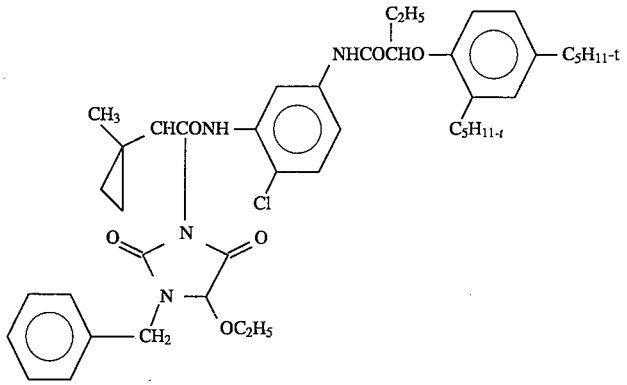

22.8 g of exemplified compound Y-35 are dissolved in 300 ml of methylene chloride, and 5.4 g of sulfuryl chloride are dropped under ice cooling over 10 minutes. After the reaction is continued for 30 minutes, the reaction solution is washed well with water. The resultant solution is dried by sodium sulfate anhydride and condensed to obtain a liquid product of compound Y-35. This liquid product of compound Y-35 is dissolved in 50 ml of N,N-dimethylformaldehyde, and the resultant solution is dropped in a solution of 18.7 g of 1-benzyl-5-ethoxyhydantoin, 11.2 ml of triethylamine, and 500 ml of N,N-dimethylformamide at room temperature over 30 minutes.

Thereafter, the reaction is continued at 40° C. for four hours, and the reaction solution is extracted with 300 ml of ethyl acetate. After washed with water, the resultant material is washed with 300 ml of a 2% aqueous triethylamine solution and neutralized by diluted hydrochloric acid. After the organic layer is dried by sodium sulfate anhydride, the solvent is distilled off to obtain an oily product. This oily product is crystallized in a solvent mixture of n-hexane and ethyl acetate. The precipitated crystals are filtered out, washed with a solvent mixture of n-hexane and ethyl acetate, and dried. As a result, 22.8 g of crystals of exemplified compound Y-1 are obtained.

The structure of the obtained compound is confirmed by MS spectrum, NMR spectrum, and elemental analysis. The compound has a melting point of 132° to 133° C.

A cyan coupler, i.e., a phenol type cyan coupler represented by formula (II) or (III) which is contained in the silver halide color photographic light-sensitive material of the present invention will be described in detail below.

In formula (II) or (III), $R^{21}$ represents a straight-chain, branched, or cyclic alkyl group which has 1 to 36 (preferably 1 to 24) carbon atoms and which may be substituted and may contain an unsaturated bond, an aryl group which has 6 to 36 (preferably 6 to 24) carbon atoms and may be substituted, or a heterocyclic group which has 2 to 36 (preferably 2 to 24) carbon atoms and may be substituted. The heterocyclic group means a 5- to 7-membered heterocyclic group which contains at least one heteroatom selected from N, O, S, P, Se, and Te in its ring and the ring of which may be condensed. Examples of the heterocyclic group are 2-furyl, 2-thienyl, 4-pyridyl, 2-imidazolyl, and 4-xynolyl.

Examples of the substituent for $R^{21}$ are a halogen atom, cyano, nitro, carboxyl, sulfo group, an alkyl group, an aryl group, a heterocyclic group, an alkoxyl group, an aryloxy group, an alkylthio group, an arylthio group, an alkylsulfonyl group, an arylsulfonyl group, an alkoxycarbonyl group, an aryloxycarbonyl group, an acyl group, a carbonamide group, a sulfonamido group, a carbamoyl group, a sulfamoyl group, a ureido group, an alkoxycarbonylamino group, and a sulfamoylamino group (to be referred to as "substituent group A"). Of these substituents, preferable substituent are a halogen atom (F, Cl, Br, or I), cyano, an alkyl group, an aryloxy group, an alkylsulfonyl group, an arylsulfonyl group, a carbonamide group, and a sulfonamide group.

In formula (II), $R^{21}$ represents preferably an alkyl group. More preferably, it represents an alkyl group having 10 or less carbon atoms, more preferably an alkyl group having 2 to 8 carbon atoms, and most preferably, ethyl, butyl, hexyl or octyl. Particularly preferred is ethyl or butyl.

In formula (II), Y represents preferably an alkyl or aryloxy group, having 6 to 20 carbon atoms. When Y is an alkyl group, the alkyl group preferably has 8 to 12 carbon atoms. When Y is an aryloxy group, it preferably has one or two substituents on the aromatic ring of the aryloxy group. The substituent on the aromatic ring is preferably a halogen atom or an alkyl group, particularly, a chlorine atom or a t-alkyl group such as t-butyl, t-amyl or t-octyl.

In formula (III), $R^{21}$ represents preferably an alkyl group or an aryl group, having 1 to 24 carbon atoms. When $R^{21}$ represents an alkyl group, it is preferably substituted with an electron-withdrawing substituent such as a halogen atom, a cyano group or a sulfonyl group, and more preferably substituted with a fluorine atom. When $R^{21}$ represents an aryl group, it preferably has an electron-withdrawing substituent such as a halogen atom, a cyano group or a sulfonyl group on the aromatic ring of the aryl group. The aryl group is substituted most preferably with a chlorine atom or a fluorine atom. $R^{21}$ represents most preferably heptafluoropropyl, 2-chlorophenyl, 2,6-dichlorophenyl or pentafluorophenyl.

In formula (II), $R^{22}$ represents a straight-chain branched, or cyclic alkyl group having 2 to 36 (preferably 2 to 24) carbon atoms. $R^{22}$ preferably represents an alkyl group having 2 to 8 carbon atoms (e.g., ethyl, propyl, isopropyl, t-butyl, or cyclopentyl). Most preferred is ethyl.

In formula (II) or (III), $R^{23}$ represents hydrogen, a halogen atom (F, Cl, Br, or I), a straight-chain, branched, or cyclic alkyl group having 1 to 16 (preferably 1 to 8) carbon atoms, an aryl group having 6 to 24 (preferably 6 to 12) carbon atoms, an alkoxyl group having 1 to 24 (preferably 1 to 8) carbon atoms, an alkoxy group having of 1 to 24 (preferably 1 to 8) carbon atoms, an aryloxy group having 6 to 24 (preferably 6 to 12), a carbonamido group having 1 to 24 (preferably 2 to 12) carbon atoms, or a ureido group having 1 to 24 (preferably 1 to 12) carbon atoms. When $R^{23}$ represents an alkyl group, an aryl group, an alkoxy group, an aryloxy group, a carbonamido group, or a ureido group, it may be substituted with a substituent selected from the substituent group A described above.

In formula (II), $R^{23}$ preferably represents a halogen atom, particularly chlorine. In formula (III), $R^{23}$ preferably represents hydrogen, a halogen atom, an alkoxy group, or a carbonamide group, and most preferably represents hydrogen.

In formula (II), $R^{22}$ and $R^{23}$ may combine together to form a ring. In formula (III), $R^{23}$ and $R^{24}$ may combine together to form a ring. At this time, $R^{23}$ may be a single bond or a constituting element as an imino group.

In formula (III), $R^{24}$ is the same as $R^{21}$, or represents an alkoxy group having 1 to 36 (preferably 1 to 24) carbon atoms, an aryloxy group having 6 to 36 (preferably 6 to 24) carbon atoms, or an alkyl- or aryl-substituted amino group having 1 to 36 (preferably 1 to 24) carbon atoms. $R^{24}$ is preferably the same as $R^{21}$ and more preferably an alkyl group.

In formula (II) or (III), X' represents a coupling split-off group which can be split off upon a coupling reaction with hydrogen or an oxidized form of an aromatic primary amine developing agent. Examples of this coupling split-off group are a halogen atom (e.g., F, Cl, Br, or I), a sulfo group, an alkoxy group having 1 to 36 (preferably 1 to 24) carbon atoms, an aryloxy group having 6 to 36 (preferably 6 to 24) carbon atoms, an acyloxy group having 2 to 36 (preferably 2 to 24) carbon atoms, an alkyl or arylsulfonyloxy group having 1 to 36 (preferably 1 to 24) carbon atoms, an alkylthio group having 1 to 36 (preferably 1 to 24), an arylthio group having 6 to 36 (preferably 6 to 24) carbon atoms, an imide group having 4 to 36 (preferably 4 to 24) carbon atoms, a carbomoyloxy group having 1 to 36 (preferably 1 to 24) carbon atoms, and a heterocyclic group (e.g., tetrazole-5-yl, pyrazolyl, imidazolyl, 1,2,4-triazole-1-yl) which has 1 to 36 (preferably 1 to 24) carbon atoms and combines with a coupling active site via its nitrogen. The groups following the alkoxy group may be substituted with groups selected from the substituent group A described above. In formula (II) or (III), X' preferably represents hydrogen, fluorine, chlorine, sulfo group, an alkoxy group, or an aryloxy group and particularly preferably hydrogen or chlorine.

Examples of each group in formula (II) or (III) and examples of the compounds represented by formula (II) and (III) will be listed below:

(1) Examples of $R^{21}$

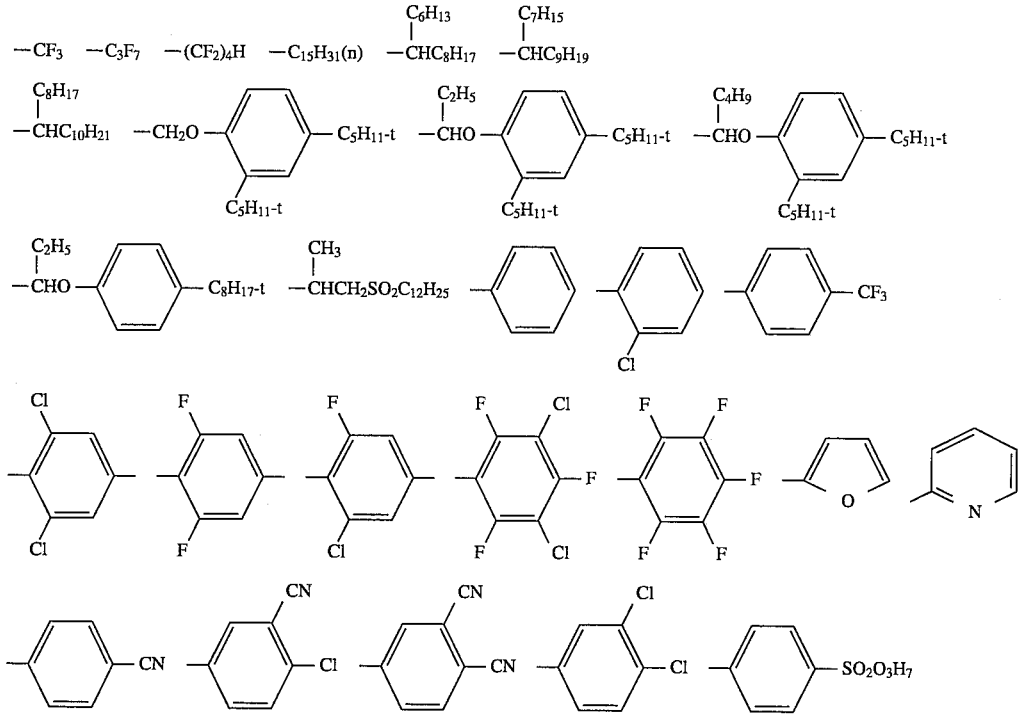

(2) Examples of $R^{22}$

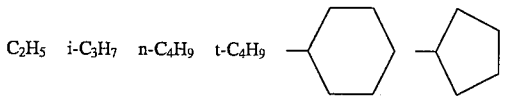

(3) Examples of $R^{23}$

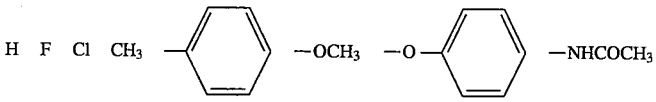

(4) Examples of $R^{24}$ (in addition to the examples of $R^{21}$)

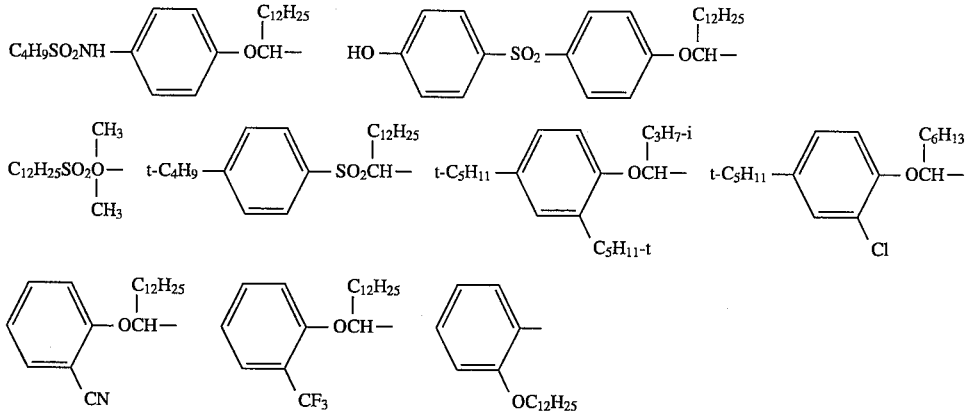

-continued
(5) Examples of X'
H F Cl Br I $SO_3H$ $-OCH_2COOCH_3$ $-OCH_2CH_2CH_2COOH$
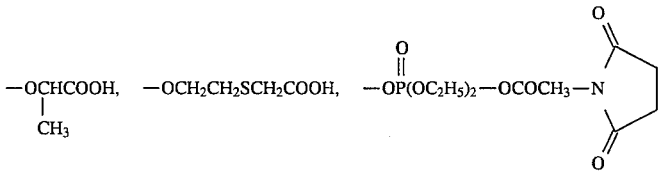
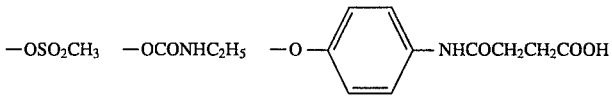
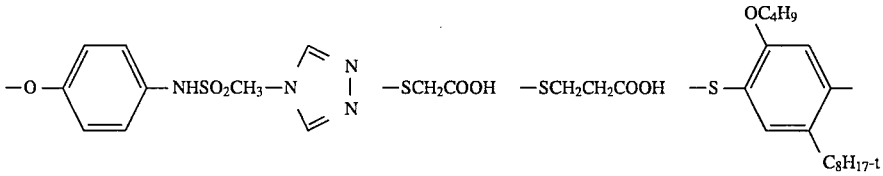
Practical examples IIC-1 to IIC-18 of the coupler represented by formula (II) will be described below.
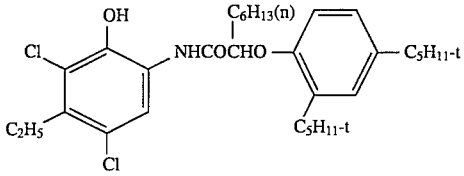
IIC-1
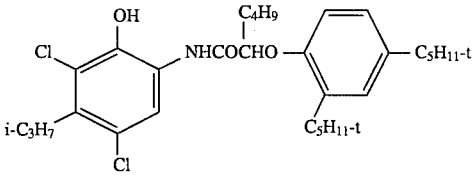
IIC-2
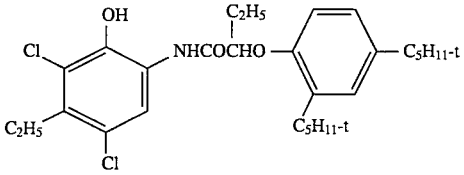
IIC-3
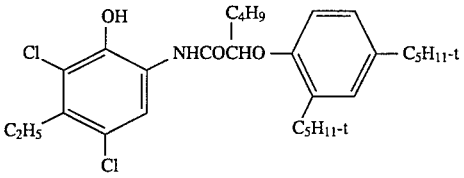
IIC-4
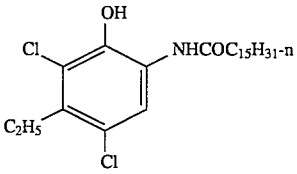
IIC-5

-continued
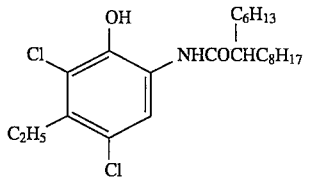
IIC-6
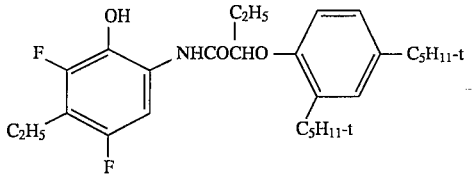
IIC-7
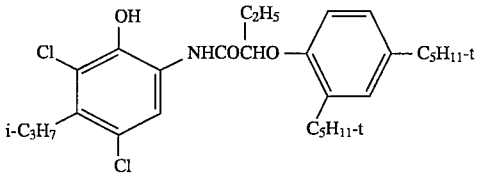
IIC-8
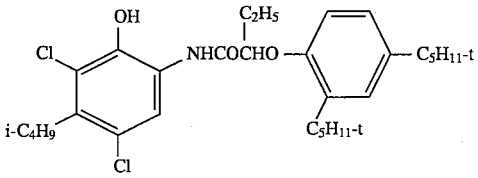
IIC-9
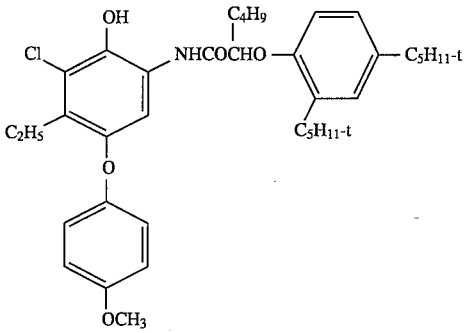
IIC-10
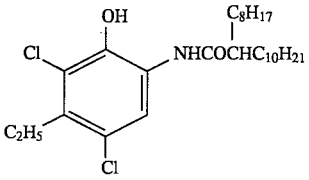
IIC-11
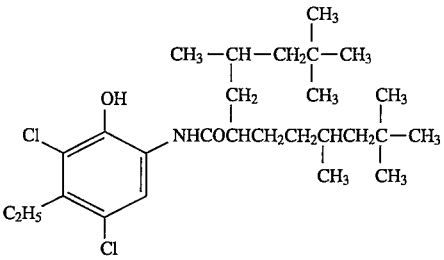
IIC-12

-continued
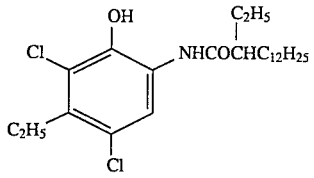
IIC-13
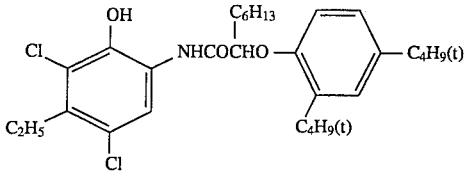
IIC-14
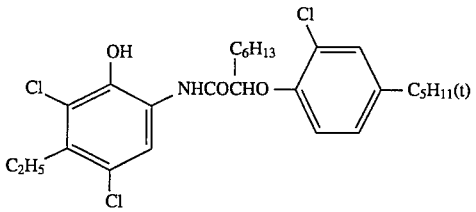
IIC-15
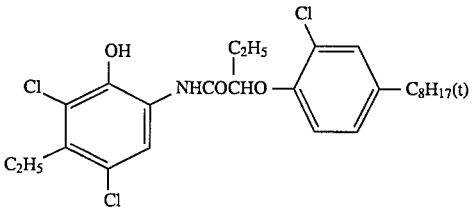
IIC-16
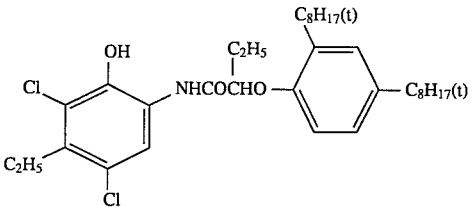
IIC-17
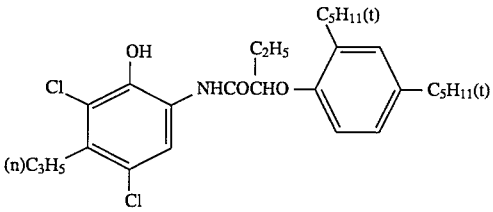
IIC-18
Practical examples IIIC-11 to IIIC-25 of the coupler represented by formula (III) will be described below:
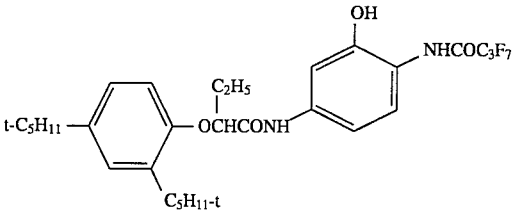
IIIC-11

-continued
IIIC-12
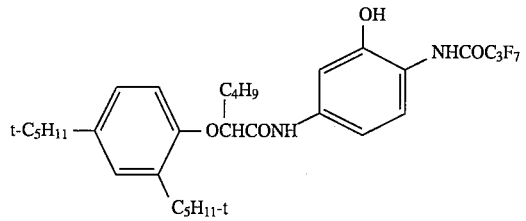
IIIC-13
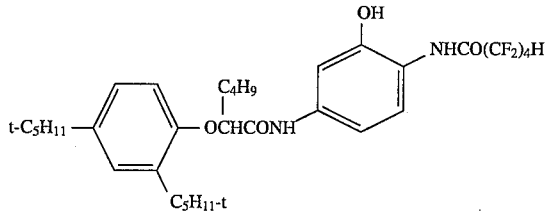
IIIC-14
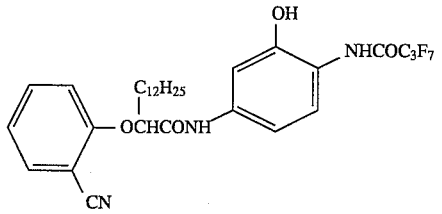
IIIC-15
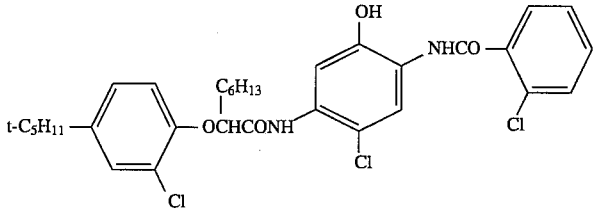
IIIC-16
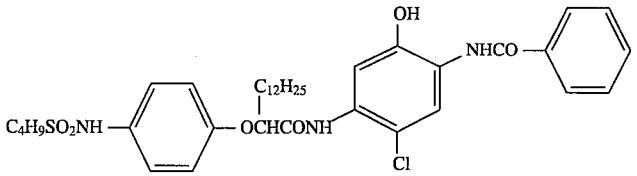
IIIC-17
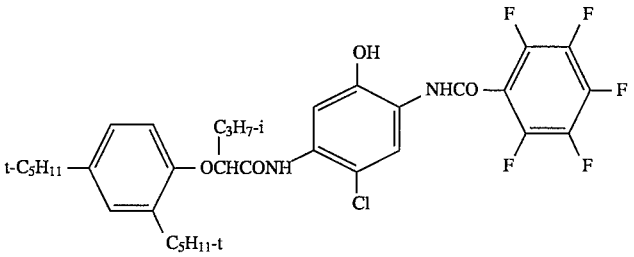
IIIC-18
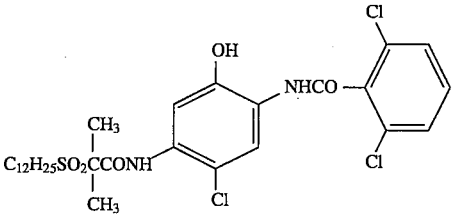

-continued

IIIC-19

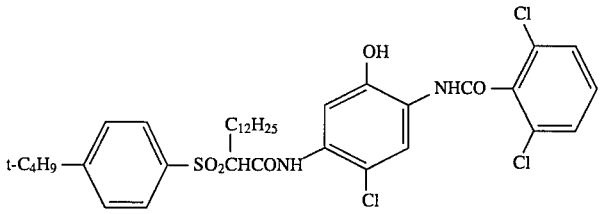

IIIC-20

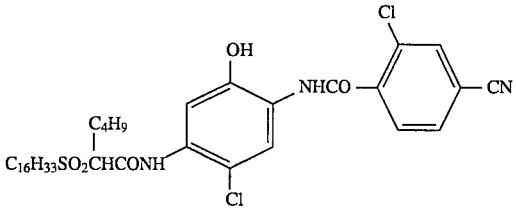

IIIC-21

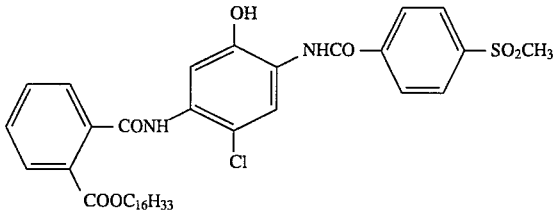

IIIC-22

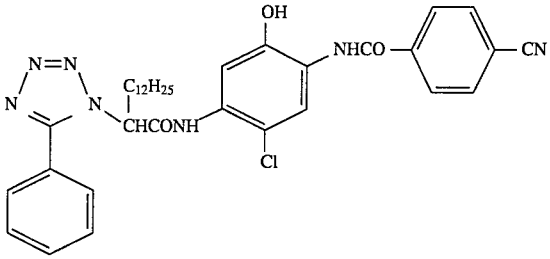

IIIC-23

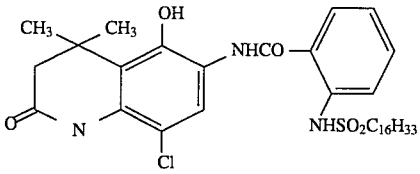

IIIC-24

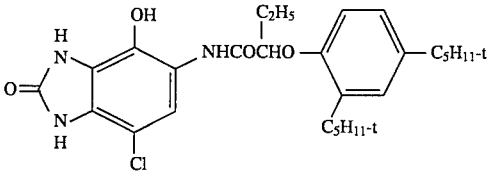

IIIC-25

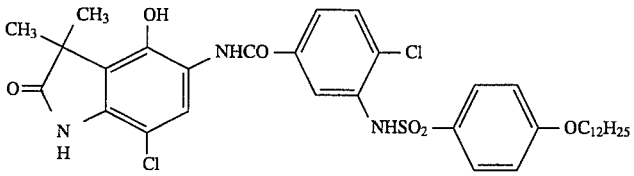

Other practical examples of each substituent represented by formula (II) or (III) and methods of synthesizing cyan couplers including these examples are described in U.S. Pat. Nos. 2,369,929, 2,772,162, 2,895,826, 3,772,002, 4,327,173, 4,333,999, 4,334,011, 4,430,423, 4,500,635, 4,518,687, 4,564,586, 4,609,619, 4,686,177, and 4,746,602, and JP-A-59-164555.

It is preferred that the cyan coupler represented by formula (II) and/or (III) occupies at least 60 mol % of all cyan coupler used.

Examples of a silver halide which can be used in the present invention are silver chloride, silver bromide, silver (iodo)chlorobromide, and silver bromoiodide. For the purpose of particularly rapid processing, it is preferable to use silver chlorobromide or silver chloride emulsion not essentially containing silver iodide and having a silver chloride content of 90 mol % or more, more preferably 95 mol % or more, and most preferably 98 mo % or more.

In order to improve the sharpness or the like of an image, dyes (particularly, an oxonol-based dye), which can be decolored by treatments described in EPO 337,490A2, pages 27 to 76, are preferably added to the light-sensitive material according to the present invention such that an optical reflection density at 680 nm of the light-sensitive material is 0.70 or more. For the same purpose, it is also preferably to add 12 wt % or more (more preferably 14 wt % or more) of titanium oxide, which is surface-treated with 2- to 4-valent alcohols (e.g., trimethylolethane), to a water-resistant resin layer on a support.

The yellow coupler represented by formula (I) and the cyan coupler represented by formula (II) or (III) may be used together with yellow and cyan couplers except for those described above, respectively. The yellow and cyan couplers except for those described above are preferably couplers, except those represented by formula (I) to (III) of the present invention, selected from the ones described in JP-A-62-215272, JP-A-2-333144. and EPO 355,660A2 to be described later.

In the light sensitive material of the present invention, at least one red-sensitive silver halide emulsion layer, at least one green-sensitive silver halide emulsion layer, at least one blue-sensitive silver halide emulsion layer, and an arbitrary layer are arranged on a support described later, with a suitable layer arrangement. According to the present invention, it is preferably for the silver halide color photographic light-sensitive material to have a layer arrangement such that the blue-sensitive silver halide emulsion layer, which contains the yellow coupler represented by formula (I) described above, lies close to a reflective support than the red-sensitive silver halide emulsion layer, which contains the cyan coupler represented by formula (II) or (III) described above.

According to the present invention, the coating amount of coupler in each layer is 0.1 mmol/$m^2$ to 2 mmol/$m^2$, and more preferably 0.3 mmol/$m^2$ to 1 mmol/$m^2$ i.e., per square meters of the silver halide color photographic light-sensitive material. The coating amount of the silver halide emulsion in the silver halide emulsion layer is preferably 2 mol to 10 mol (figured out as Ag atoms) and more preferably 2 mol to 5 mol per mol of the coupler.

A high boiling point organic solvent for photographic additives such as cyan, magenta, and yellow couplers used in the present invention can be a compound which is not miscible with water and has a melting point of 100° C. or less and a boiling point of 140° C. or more and which is a good solvent of the couplers. The melting point of the high boiling point organic solvent is preferably 80° C. or less. The boiling point of the high boiling point organic solvent is preferably 160° C. or more, and more preferably 170° C. or more.

The high boiling point organic solvents are described in detail in the lower right column of page 137 to the upper right column of page 144 in the specification of JP-A-62-215272.

The cyan, magenta, or yellow coupler can be impregnated in a loadable latex polymer (e.g., U.S. Pat. No. 4,203,716) in the presence or absence of the high boiling point organic solvent or can be emulsified and dispersed in a hydrophilic colloidal aqueous solution in which a polymer insoluble in water and soluble in an organic solvent is dissolved.

A homopolymer or copolymer described in U.S. Pat. No. 4,856,449 and on pages 12 to 30 of the specification of WO 88/00723 is used. More preferably, a methacrylate- or acrylamide-based polymer is used. In particular, an acrylamide-based polymer is preferable in favor of dye image stability and the like.

In addition, in the light-sensitive material according to the present invention, it is preferable to use storage of dye image-stability improving compound as described in EPO 277,589SA2, and particularly a pyrazoloazole coupler.

That is, it is preferable to use one or both of a compound (F) which chemically combines with an aromatic amine-based developing agent remaining after color development to produce a chemically inactive and essentially colorless compound and/or a compound (G) which chemically combines with an oxidant of an aromatic amine-based color developing agent remaining after development to produce a chemically inactive and essentially colorless compound. This is preferable in, e.g., preventing formation of stains or other side effects caused by a colored dye produced when a color developing agent or an oxidant of the agent remaining in a film reacts with a coupler during storage after the processing.

In the light-sensitive material according to the present invention, a fungicide as described in JP-A-63-271247 is preferably added in order to prevent various mildews or bacteria which multiply in a hydrophilic colloid layer to deteriorate an image.

As a support for use in the light-sensitive material according to the present invention, it may be preferable to use a reflective support such as a resin coated paper, a white polyester-based support, or a support in which a layer containing a white pigment is formed on the side of silver halide emulsion layers. In order to further improve a sharpness, an antihalation layer is preferably formed on the silver halide emulsion coating side or the reverse surface of the support. The transmission density of the support is preferably set within the range of 0.35 to 0.8 so that a display can be watched by reflected light or transmitted light.

The light sensitive material of the present invention may be exposed to visible light or infrared light. The exposure method may be either low-illuminance exposure or high-illuminance short-time exposure. In the case of particularly the latter method, it is preferable to adopt a laser scanning exposure scheme in which the exposure time per pixel is shorter than $10^{-4}$ sec.

In exposure, a band stop filter described in U.S. Pat. No. 4,880,726 is preferably used. Since color mixing is removed by this filter, color reproducibility is significantly improved.

The exposed light-sensitive material is subjected to conventional monochrome development or color development, but is preferably subjected to bleach-fixing after color development for the purpose of rapid processing. Especially when the high silver chloride emulsion described above is used, the pH of a bleach-fixing solution is preferably about 6.5 or less, and more preferably about 6 or less in order to accelerate desilvering.

Preferable examples of the silver halide emulsions or other materials (e.g., additives) and photographic constituting layers (e.g., a layer arrangement) applied to the light-sensitive material according to the present invention, and methods and additives applied to process the light-sensitive material are described in published patent specifications to be described later, and particularly EPO 355,660A2 (JP-A-2-139544).

The descriptive parts of the photographic constituting elements described in the following published patent applications and used in the light-sensitive material according to the present invention are listed in Table shown below.

| Photographic constituting element | JP-A-62-215272 | JP-A-2-33144 | EPO 355,660A2 |
|---|---|---|---|
| Silver halide emulsion | Line 6, upper right column, page 10 to line 5, lower left column, page 12, and the fourth lien from the bottom, lower right column, page 12 to line 17, upper left column, page 13 | Line 16, upper right column, page 28 to line 11, lower right column, page 29, and lines 2 to 5, page 30 | Line 53, page 45 to line 3, page 47, and lines 20 to 22, page 47 |
| Silver halide solvent | Lines 6 to 14, lower left column, page 12, and the third line from the bottom, upper left column, page 13 to last line, lower left column, page 18 | | |
| Chemical sensitizer | The third line from the bottom, lower left column to the fifth line from the bottom, lower right column, page 12, and line 1, lower right column, page 18 to the ninth line from the bottom, upper right column, page 22 | Line 12 to last line, lower right column, page 29 | Lines 4 to 9, page 47 |
| Spectral sensitizer (spectral sensitizing method) | The eighth line from the bottom, upper right column, page 22 to last line, page 38 | Lines 1 to 13, upper left column, page 30 | Lines 10 to 15, page 47 |
| Emulsion stabilizer | Line 1, upper left column, page 39 to last line, upper right column, page 72 | Line 14, upper left column to line 1, upper right column, page 30 | Lines 16 to 19, page 47 |
| Development accelerator | Line 1, lower left column, page 72 to line 3, upper right column, page 91 | — | — |
| Color couplers (cyan, magenta and yellow couplers) | Line 4, upper right column, page 91 to line 6, upper left column, page 121 | Line 14, upper right column, page 3 to last line, upper left column, page 18, and line 6, upper right column, page 30 to line 11, lower right column, page 35 | Lines 15 to 27, page 4, line 30, page 5 to last line, page 28, lines 29 to 31, page 45, and line 23, page 47 to line 50, page 63 |

-continued

| Photographic constituting element | JP-A-62-215272 | JP-A-2-33144 | EPO 355,660A2 |
|---|---|---|---|
| Color booster | Line 7, upper left column, page 121 to line 1, upper right column, page 125 | — | — |
| Ultraviolet absorbent | Line 2, upper right column, page 125 to last line, lower left column, page 127 | Line 14, lower right column, page 37 to line 11, upper left column, page 38 | Line 22 to 31, page 65 |
| Discoloration inhibitor (image stabilizer) | Line 1, lower right column, page 127 to line 8, lower left column, page 137 | Line 12, upper right column, page 36 to line 19, upper left column, page 37 | Line 30, page 4 to line 23, page 5, line 1, page 29 to line 25, page 45, lines 33 to 40, page 45, and lines 2 to 21, page 65 |
| High and/or low boiling point organic solvents | Line 9, lower left column, page 137 to last line, upper right column, page 144 | Line 14, lower right column, page 35 to the fourth line from the bottom, upper left column, page 36 | Lines 1 to 51, page 64 |
| Method of dispersing photographic additives | Line 1, lower left column, page 144 to line 7, upper right column, page 146 | Line 10, lower right column, page 27 to last line, upper left column, page 28, and line 12, lower right column, page 35 to line 7, upper right column, page 36 | Line 51, page 63 to line 56, page 64 |
| Film hardener | Line 8, upper right column, page 146 to line 4, lower left column, page 155 | — | — |
| Developing agent precursor | Line 5, lower left column, page 155 to line 2, lower right column, page 155 | — | — |
| Development inhibitor releasing compound | Lines 3 to 9, lower right column, page 155 | — | — |
| Support | Line 19, lower right column, page 155 to line 14, upper left column, page 156 | Line 18, upper right column, page 38 to line 3, upper left column, page 39 | Line 29, page 66 to line 13, page 67 |
| Arrangement of light-sensitive material layers | Line 15, upper left column, page 156 to line 14, lower right column, page 156 | Lines 1 to 15, upper right column, page 28 | Lines 41 to 52, page 45 |
| Dye | Line 15, lower right column, page 156 to last line, | Line 12, upper left column to line 7, upper right column, | Lines 18 to 22, page 66 |

| Photographic constituting element | JP-A-62-215272 | JP-A-2-33144 | EPO 355,660A2 |
|---|---|---|---|
| | lower right column, page 184 | page 38 | |
| Color mixing inhibitor | Line 1, upper left column, page 185 to line 3, lower right column, page 188 | Lines 8 to 11, upper right column, page 36 | Line 57, page 64 to line 1, page 65 |
| Gradation adjusting agent | Lines 4 to 8, lower right column, page 188 | — | — |
| Stain inhibitor (Anti-stain agent) | Line 9, lower right column, page 188 to line 10, lower right column, page 193 | Last line, upper left column to line 13, lower right column, page 37 | Line 32, page 65 to line 17, page 66 |
| Surfactant | Line 1, lower left column, page 201 to last line, upper right column, page 210 | Line 1, upper right column, page 18 to last line, lower right column, page 24, and the tenth line from the bottom, lower left column to line 9, lower right column, page 27 | — |
| Fluorine-containing compound (to be used as, e.g., antistatic agent, coating aid, lubricant, and antiadhesion agent) | Line 1, lower left column, page 210 to line 5, lower left column, page 222 | Line 1, upper left column, page 25 to line 9, lower right column, page 27 | — |
| Binder (hydrophilic colloid) | Line 6, lower left column, page 222 to last line, upper left column, page 225 | Lines 8 to 18, upper right column, page 38 | Lines 23 to 28, page 66 |
| Thickening agent | Line 1, upper right column, page 225 to line 2, upper right column, page 227 | — | — |
| Antistatic agent | Line 3, upper right column, page 227 to line 1, upper left column, page 230 | — | — |
| Polymer latex | Line 2, upper left column, page 230 to last line, page 239 | — | — |
| Matting agent | Line 1, upper left column, page 240 to last line, upper right column, page 240 | — | — |

| Photographic constituting element | JP-A-62-215272 | JP-A-2-33144 | EPO 355,660A2 |
|---|---|---|---|
| Photographic processing method (e.g., processing step or additives) | Line 7 upper right column, page 3 to line 5, upper right column, page 10 | Line 4, upper left column, page 39 to last line, upper left column, page 42 | Line 14, page 67 to line 28, page 69 |

In the Table show above, a portion cited from JP-A-62-215272 includes the contents amended by the amendment, dated Mar. 16, 1987, described at the end of the publication.

Of the above couplers, it is preferable to use, as a yellow couplers, so-called short-wave type yellow couplers described in JP-A-63-231451, JP-A-63-123047, JP-A-63-241547, JP-A-173499, JP-A-1-213648, and JP-A-1-250944.

As a cyan coupler, in addition to a diphenylimidazole cyan coupler described in JP-A-2-33144, the use of a 3-hydroxypyridine cyan coupler (particularly a two-equivalent polymer obtained by introducing a chlorine-elimination group to a 4-equivalent coupler of a coupler (42), or a coupler (6) or (9) enumerated as a practical example is most preferable) described in EPO 333,185A2, or a cyclic active methylene cyan coupler (particularly couplers 3, 8, and 34 enumerated as practical examples are most preferable) described in JP-A-64-32260 is also preferable.

A method described in the upper left column of page 27 to the upper right column of page 34 of JP-A-2-207250 is preferably used as a method of processing a silver halide color light-sensitive material using a silver chloride rich emulsion containing 90 mol % or more of silver chloride.

The present invention will be described in detail by way of its examples. Compounds represented by symbols in the following example are shown in Table A to be listed below.

Example 1

After corona discharge treatment was performed on the surface of a paper support, both the surfaces of which were laminated with polyethylene, a gelatin under-coating layer containing, e.g., sodium dodecylbenzenesulfonate was formed on the support, and various photographic constituting layers were coated on it, thus manufacturing a multi-layered color photographic paper (sample 101) having the following layer arrangement. The coating solutions were prepared as follows.

In the following layer arrangement, numerical values indicate that the coating amounts ($g/m^2$) are represented in terms of the coating amounts of silver in silver halide emulsions.

(Sample 101)

Support

Polyethylene coated paper [containing a white pigment ($TiO_2$) and a blue dye (ultramarine blue) in polyethylene on the first layer side]

| | |
|---|---|
| First Layer (Blue-sensitive emulsion layer) | 0.30 |
| Silver chlorobromide emulsion (cubic, 13:7 mixture (Ag molar ratio) of a large-sized emulsion having an average grain size of 0.88 μm and a small-sized emulsion having that of 0.70 μm. The variation coefficients of grain size distributions | |

| | |
|---|---|
| of the two emulsion were 0.08 and 0.10, respectively. Each emulsion locally contained 0.3 mol % of silver bromide in a portion of the surface of each grain.) | |
| Gelatin | 1.96 |
| Yellow coupler (ExY) | 0.88 |
| Dye image stabilizer (Cpd-1) | 0.19 |
| Solvent (Solv-3) | 0.19 |
| Solvent (Solv-7) | 0.19 |
| Dye image stabilizer (Cpd-7) | 0.06 |
| Second Layer (Color mixing inhibiting layer) | |
| Gelatin | 0.99 |
| Color mixing inhibitor (Cpd-5) | 0.08 |
| Solvent (Solv-1) | 0.16 |
| Solvent (Solv-4) | 0.08 |
| Third Layer (Green-sensitive emulsion layer) | |
| Silver chlorobromide emulsion (Cubic, a 1:3 mixture (Ag molar ratio) of a large-size emulsion having an average grain size of 0.55 μm and a small-size emulsion having that of 0.39 μm. The variation coefficients of grain size distributions of the two emulsions were 0.10 and 0.08, respectively. Each emulsion locally contained 0.8 mol % of AgBr in a portion of the surface of each grain.) | 0.12 |
| Gelatin | 1.24 |
| Magenta coupler (ExM) | 0.23 |
| Dye image stabilizer (Cpd-2) | 0.01 |
| Dye image stabilizer (Cpd-3) | 0.16 |
| Dye image stabilizer (Cpd-4) | 0.01 |
| Dye image stabilizer (Cpd-9) | 0.02 |
| Solvent (Solve-2) | 0.40 |
| Fourth Layer (Ultraviolet absorbing layer) | |
| Gelatin | 1.58 |
| Ultraviolet absorbent (UV-1) | 0.47 |
| Color mixing inhibitor (Cpd-5) | 0.05 |
| Solvent (Solv-5) | 0.24 |
| Fifth Layer (Red-sensitive emulsion layer) | |
| Silver chlorobromide emulsion (cubic, a 1:4 mixture (Ag molar ratio) of a large-size emulsion having an average grain size of 0.58 μm and a small-size emulsion having that of 0.45 μm. The variation coefficients of grain size distributions of the two emulsions were 0.09 and 0.11, respectively. Each emulsion locally contained 0.6 mol % of AgBr in a portion of the surface of each grain.) | 0.23 |
| Gelatin | 1.38 |
| Cyan coupler (ExC) | 0.34 |
| Dye image stabilizer (Cpd-2) | 0.03 |
| Dye image stabilizer (Cpd-4) | 0.02 |
| Dye image stabilizer (Cpd-6) | 0.18 |
| Dye image stabilizer (Cpd-7) | 0.40 |
| Dye image stabilizer (Cpd-8) | 0.05 |
| Solvent (Solv-6) | 0.15 |
| Sixth Layer (Ultraviolet absorbing layer) | |
| Gelatin | 0.53 |
| Ultraviolet absorbent (UV-1) | 0.16 |
| Color mixing inhibitor (Cpd-5) | 0.02 |

| | |
|---|---|
| Solvent (Solv-5) | 0.08 |
| Seventh Layer (Protective layer) | |
| Gelatin | 1.33 |
| Acryl-modified copolymer (modification degree = 17%) of polyvinylalcohol | 0.17 |
| Liquid paraffin | 0.03 |

Preparation of a coating layer of the fifth layer will be exemplified as a preparation example of a coating solution of each layer. Note that coating solutions of the first to fourth layers and those of the sixth end seventh layers are prepared following the same procedures as in the coating solution of the fifth layer.

Preparation of Coating Solution of Fifth Layer 50.0 cc of ethyl acetate and 14.0 g of the solvent (Solv-6) were added to 32.0 g of the cyan coupler (E° C.), 3.0 g of the dye image stabilizer (Cpd-2), 2.0 g of the dye image stabilizer (Cpd-4), 18.0 g of the dye image stabilizer (Cpd-6), 40.0 g of the dye image stabilizer (Cpd-7), and 5.0 g of the dye image stabilizer (Cpd-8) to dissolve the cyan coupler and the dye image stabilizers. The resultant solution was added to 500 cc of 20% aqueous gelatin solution containing 8 cc of sodium dodecylbenzenesulfonate to emulsify and disperse the components by using an ultrasonic homogenizer to prepare an emulsified dispersion. A silver chlorobromide emulsion (cubic, a 1:4 mixture (Ag molar ratio) of a large-size emulsion having an average grain size of 0.58 μm and a small-size emulsion having that of 0.45 μm. The variation coefficients of grain size distributions of the two emulsions were 0.09 and 0.11, respectively. Each emulsion locally contained 0.6 mol % of AgBr in a portion of the surface of each grain) was prepared. The following red-sensitive sensitizing dye E was added to the large-size emulsion in an amount of $0.9\times10^{-4}$ mol per mol of silver and to the small-size emulsion in an amount of $1.1\times10^{-4}$ mol per mol of silver. Chemical ripening of these emulsions was performed by adding a sulfur sensitizer and a gold sensitizer. This red-sensitive silver chlorobromide emulsion was mixed with and dissolved in the above emulsified dispersion, thereby preparing the coating solution of the fifth layer having a composition as described above. 1-oxy-3,5-dichloro-s-triazine sodium salt was contained as a hardener of gelatin in the layer.

The dye image stabilizers Cpd-10 and Cpd-11 were added in total amounts of 25.0 mg/cm$^2$ and 50.0 mg/cm$^2$, respectively, to each layer of sample 101.

The following spectral sensitizer dyes were used in the silver chlorobromide emulsions of the blue-, green-, red-sensitive emulsions, respectively.

(Blue-sensitive emulsion layer)

Sensitizing dye A

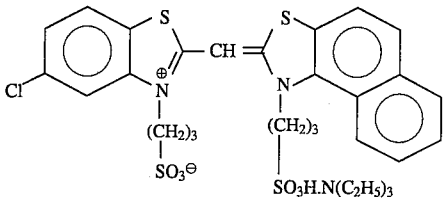

and

Sensitizing dye B

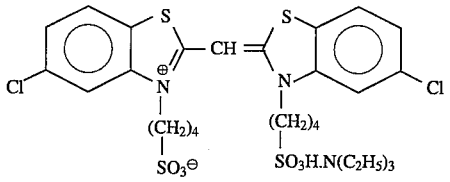

($2.0\times10^{-4}$ mol and $2.5\times10^{-4}$ mol respectively for large- and small-size emulsions per mol of the silver halide)

(Green-sensitive emulsion layer)

Sensitizing dye C

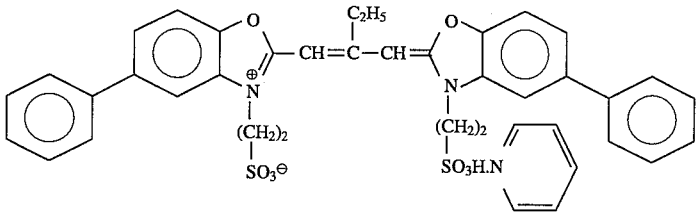

($4.0\times10^{-4}$ mol and $5.6\times10^{-4}$ mol respectively for large- and small-size emulsions per mol of the silver halide)

and

Sensitizing dye D

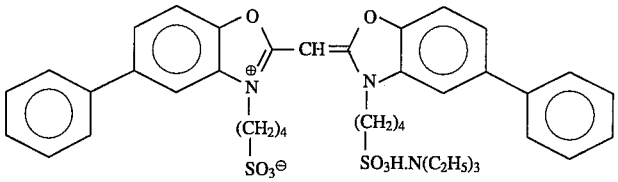

($7.0\times10^{-5}$ mol respectively for large- and small-size emulsions per mol of the silver halide)

-continued (Red-sensitive emulsion layer)

Sensitizing dye E

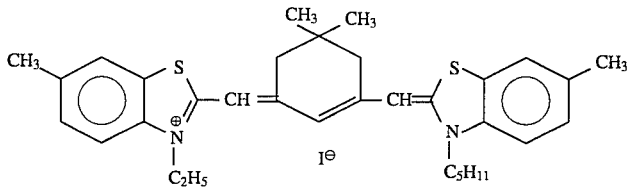

(0.9 × $10^{-4}$ mol and 1.1 × $10^{-4}$ mol respectively for large- and small-size emulsions per mol of the silver halide)

In addition, the following compound was added in an amount of $2.6\times10^{-3}$ per mol of the silver halide.

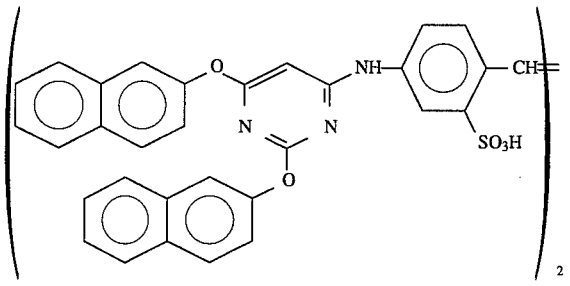

1-(5-methylureidophenyl)-5-mercaptotetrazole was added to the blue-, green-, and red-sensitive emulsion layers in amounts of $8.5\times10^{-5}$ mol, $7.7\times10^{-4}$ mol, and $2.5\times10^{-4}$ mol per mol of the silver halide, respectively. 4-hydroxy-6-methyl-1,3,3a and 7-tetrazaindene were added in amounts of $1\times10^{-4}$ mol and $2\times10^{-4}$ mol per mol of the silver halide, respectively, to each of the blue- and green-sensitive emulsion layers.

In addition, the following dyes (coating amounts are represented in the parentheses) were added to the emulsion layers for anti-irradiation.

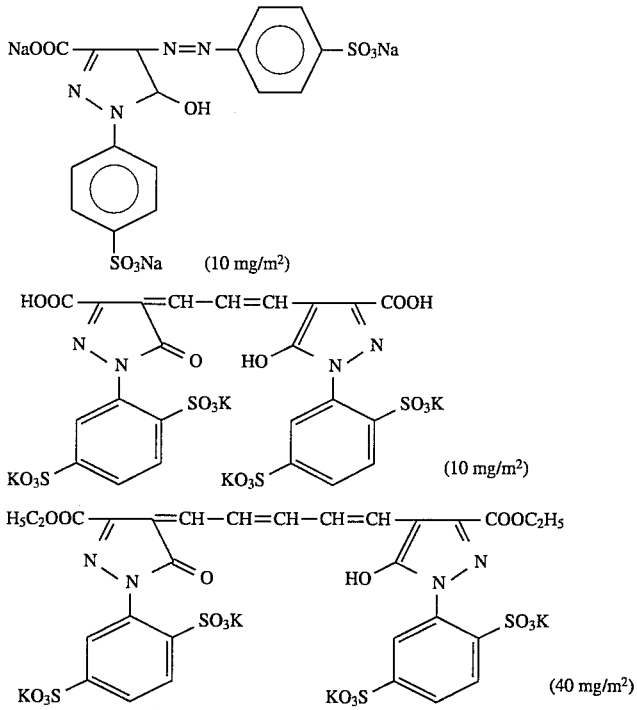

-continued

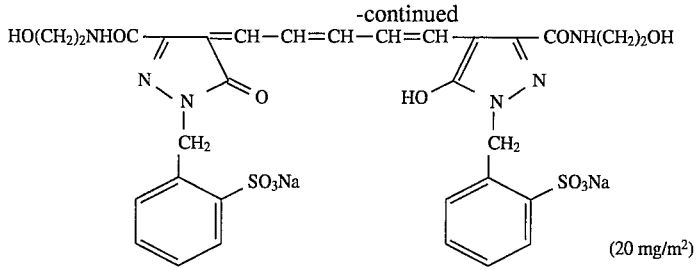

(20 mg/m²)

Preparation of Samples 102–114

Samples 102 to 114 were formed following the same procedures as in sample 101 except that the yellow coupler (ExY) and the solvents (Solv-3 and Solv-7) of the first layer and the cyan coupler (ExC) and the solvent (Solv-6) of the fifth layer in sample 101 were replaced with ones shown in Tables 1 and 2.

The mixing ratio of the total weight of the couplers, the solvents, and the dye image stabilizers to the content of gelatin in each of the first and fifth layers of each sample was adjusted to be equal to that in sample 101.

Running test

Samples 101 to 114 were exposed to white light through a developed color negative mask upon photography of a standard object. By using a paper processor, the exposed samples were subjected to a continuous processing (running test) in accordance with the following processing steps and using processing solutions having the following compositions, until the quantity of a replenisher became twice the tank volume of bleaching-fixing (Samples 101 to 114 were almost equally processed) in the bleaching-fixing step.

| Process | Temperature | Time | Replenisher* | Tank Volume |
|---|---|---|---|---|
| Color development | 35° C. | 45 sec. | 161 ml | 17 l |
| Bleach-fixing | 30° C.–35° C. | 45 sec. | 145 ml | 17 l |
| Rinsing ① | 30° C.–35° C. | 15 sec. | — | 10 l |
| Rinsing ② | 30° C.–35° C. | 15 sec. | — | 10 l |
| Rinsing ③ | 30° C.–35° C. | 15 sec. | 300 ml | 10 l |
| Drying | 70° C.–80° C. | 60 sec. | | |

| Color developer | Tank solution | Replenisher |
|---|---|---|
| Water | 800 ml | 800 ml |
| Ethylenediamine-N,N,N,N-tetramethylenephosphonic acid | 1.5 g | 2.0 g |
| Potassium bromide | 0.015 g | — |
| Triethanolamine | 8.0 g | 12.0 g |
| Sodium chloride | 1.4 g | — |
| Potassium carbonate | 25 g | 25 g |
| N-ethyl-N-(β-methanesulfonamideethl)-3-methyl-4-amino aniline sulfate | 5.0 g | 7.0 g |
| N,N-bis(carboxymethyl) hydrazine | 4.0 g | 5.0 g |
| N,N-(disulfoethyl) hydrozylamine.1Na | 4.0 g | 5.0 g |
| Fluorescent brightener | 1.0 g | 2.0 g |
| Water to make | 1,000 ml | 1,000 ml |
| pH (25° C.) | 10.05 | 10.45 |

-continued

| Bleach-fixing solution | (tank solution and replenisher are the same) |
|---|---|
| Water | 400 ml |
| Ammonium thiosulfate (70%) | 100 ml |
| Ammonium sulfite | 10 g |
| Ammonium ethylenediamine iron(III) tetraacetate | 55 g |
| Diammonium ethylenediamine tetraacetate | 5 g |
| Ammonium bromide | 40 g |
| Water to make | 1,000 ml |
| pH (25° C.) | 6.5 |
| Rinsing solution | (tank solution and replenisher are the same) |
| Ion exchange water | (each of calcium and magnesium is 3 ppm or less) |

(WHITES 4B, available from SUMITOMO CHEMICAL CO., LTD.)
*A replenisher is represented in a quantity per m² of a light-sensitive material.
(3-tankcounter flow system from rinsing ③ to ①

In addition, in this running balanced state, processing for evaluating stains just after processing and stains after storage was performed.

Evaluation of stains upon processing

The above samples were subjected to sensitometry as follows. First, a sensitometer (EWH type available from Fuji Photo Film. Co., Ltd., color temperature of light source=3, 200° K.) was used to apply gradation exposure through 3-colors separation filter for sensitometry to each sample. The exposure in this case was performed with an exposure amount of 250 CMS for an exposure time of 0.1 sec.

These samples were developed by processing in the running balanced state, and their densities were measured. Of all the measurement values, minimum values (densities of white background portions) of the magenta and cyan densities were defined as a value of a magenta stain upon processing and a value of cyan stain upon processing, respectively.

Evaluation of stains during storage

The samples obtained upon evaluation of the stain just after processing were left to stand at 60° C. and 70% RH for 40 days, and the densities were measured. Differences between the minimum magenta and cyan density values obtained by this measurement and the magenta and cyan minium density values (i.e., stains just after processing) obtained before the samples were left to stand at 60° C. and 70% RH were used as measures for a magenta stain during storage and a cyan stain during storage.

Results are summarized in Tables 1 and 2 below.

TABLE 1

| Sample | First layer | | Fifth layer | | Stain upon processing | | Stain during storage | | |
|---|---|---|---|---|---|---|---|---|---|
| No. | Coupler | Solvent | Coupler | Solvent | Magenta | Cyan | Magenta | Cyan | Remarks |
| 101 | ExY (0.88) | Solv-3, Solv-7 (0.19) (0.19) | ExC (0.34) | Solv-6 (0.15) | 0.08 | 0.06 | 0.18 | 0.10 | Comparative Example |
| 102 | ExY (0.88) | Solv-3, Solv-7 (0.19) (0.19) | IIC-3 (0.35) | Solv-6 (0.15) | 0.07 | 0.05 | 0.10 | 0.07 | Comparative Example |
| 103 | Y-1 (0.70) | Solv-3, Solv-7 (0.15) (0.15) | ExC (0.34) | Solv-6 (0.15) | 0.04 | 0.03 | 0.18 | 0.10 | Comparative Example |
| 104 | Y-1 (0.70) | Solv-3, Solv-7 (0.15) (0.15) | IIC-3 (0.34) | Solv-6 (0.15) | 0.03 | 0.02 | 0.07 | 0.05 | Present Invention |
| 105 | Y-1 (0.70) | Solv-3, Solv-7 (0.15) (0.15) | IIIC-17 (0.48) | Solv-6 (0.21) | 0.03 | 0.01 | 0.08 | 0.04 | Present Invention |
| 106 | Y-28 (0.73) | Solv-4 (0.51) | IIC-3 (0.35) | Solv-1 (0.21) | 0.03 | 0.02 | 0.08 | 0.05 | Present Invention |
| 107 | Y-10 (0.75) | Solv-4 (0.60) | IIC-3 (0.35) | Solv-1 (0.21) | 0.03 | 0.02 | 0.08 | 0.05 | Present Invention |

TABLE 2

| Sample | First layer | | Fifth layer | | Stain upon processing | | Stain during storage | | |
|---|---|---|---|---|---|---|---|---|---|
| No. | Coupler | Solvent | Coupler | Solvent | Magenta | Cyan | Magenta | Cyan | Remarks |
| 108 | Y-1 (0.70) | Solv-4 (0.50) | IIC-3 (0.34) | Solv-1 (0.20) | 0.03 | 0.02 | 0.07 | 0.06 | Present Invention |
| 109 | Y-28 (0.73) | Solv-4 (0.53) | IIIC-17 (0.48) | Solv-8 (0.25) | 0.03 | 0.01 | 0.08 | 0.04 | Present Invention |
| 110 | Y-18 (0.75) | Solv-4 (0.56) | IIIC-17 (0.48) | Solv-8 (0.25) | 0.03 | 0.01 | 0.08 | 0.04 | Present Invention |
| 111 | Y-1 (0.70) | Solv-1 (0.56) | ExC, IIC-17 (0.13) (0.29) | Solv-8 (0.25) | 0.04 | 0.02 | 0.07 | 0.05 | Present Invention |
| 112 | Y-28 (0.73) | Solv-1 (0.58) | ExC, IIIC-17 (0.13) (0.29) | Solv-8 (0.25) | 0.03 | 0.02 | 0.08 | 0.05 | Present Invention |
| 113 | Y-18 (0.75) | Solv-1 (0.60) | ExC, IIIC-17 (0.13) (0.29) | Solv-8 (0.25) | 0.03 | 0.02 | 0.08 | 0.06 | Present Invention |
| 114 | Y-1 (0.70) | Solv-1 (0.56) | IIC-4 (0.37) | Solv-1 (0.12), Solv-4 (0.12) | 0.03 | 0.03 | 0.07 | 0.06 | Present Invention |

As is apparent from the results in Tables 1 and 2, by using the couplers according to the present invention in only the first layer, stains during storage can be reduced. By using the couplers of the present invention in only the fifth layer, stains upon processing can be reduced. In addition, when the couplers according to the present invention are used in both the first and fifth layers, both stains upon processing and during storage can be reduced. The samples are excellent in color color-forming properties.

TABLE A (ExY) Yellow coupler

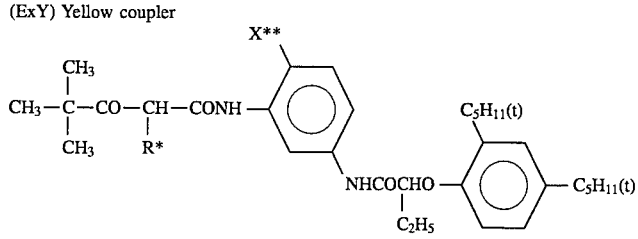

TABLE A-continued
(ExM) Magenta coupler
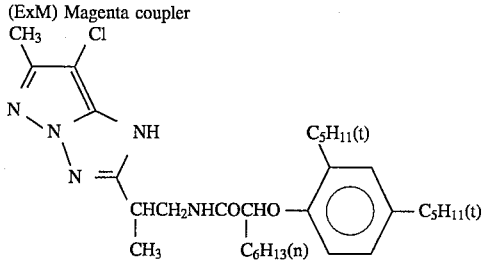
(ExC) Cyan coupler
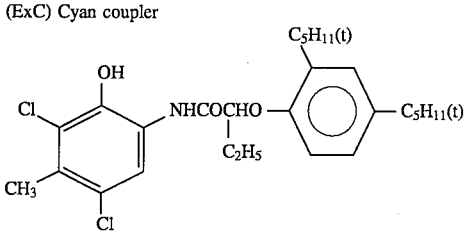
(Cpd-1) Dye image stabilzer
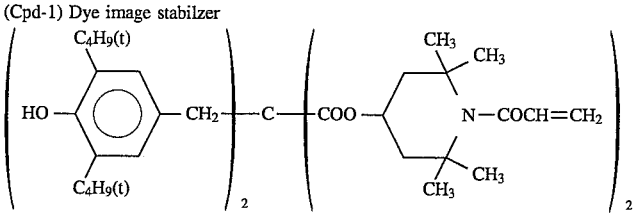
(Cpd-2) Dye image stabilizer
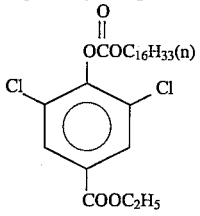
(Cpd-3) Dye image stabilizer
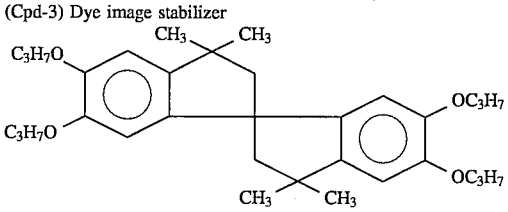
(Cpd-4) Dye image stabilizer
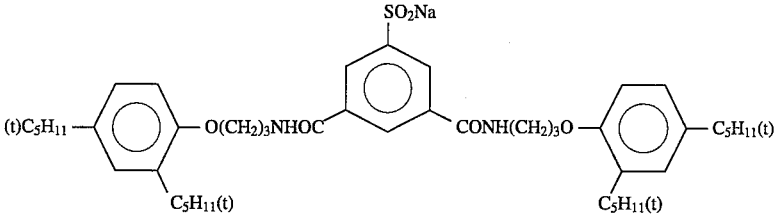
(Cpd-5) Color mixing inhibitor
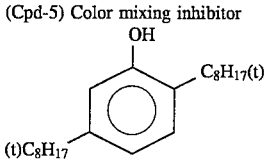

TABLE A-continued (Cpd-6) Dye image stabilizer, which is a mixture of the components listed below in the mixing ratio (weight ratio) of 2:4:4;

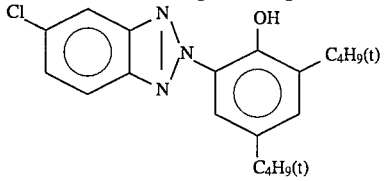

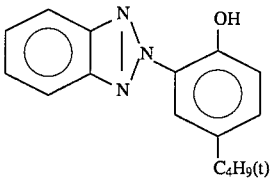

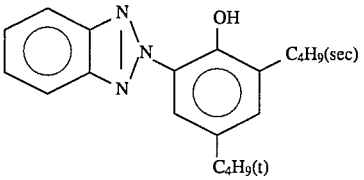

(Cpd-7) Dye image stabilizer $$\left(CH_2-\underset{\underset{CONHC_4H_9(t)}{|}}{CH}\right)_n$$

number-average molecular weight: 60,000

(Cpd-8) Dye image stabilizer, which is a mixture of the components listed below in the mixing ratio (weight ratio) of 1:1;

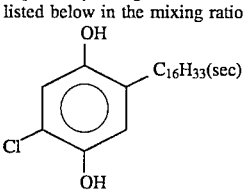

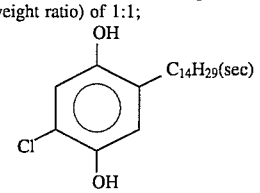

(Cpd-9) Dye image stabilizer

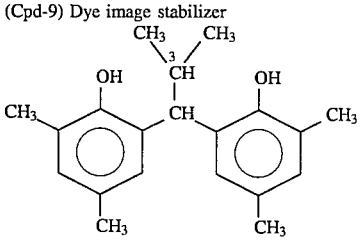

(Cpd-10) Antiseptic

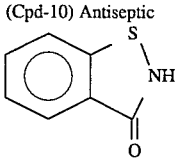

(Cpd-11) Antiseptic

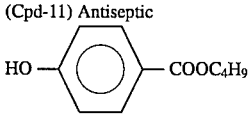

TABLE A-continued
(UV-1) Ultraviolent absorbent, which is a mixture of the components listed below in the mixing ratio (weight ratio) of 4:2:4;
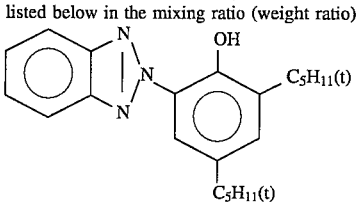
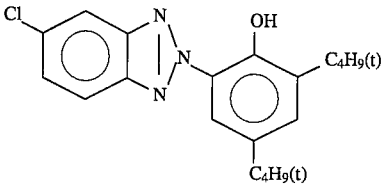
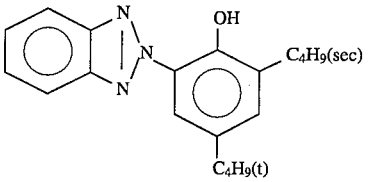
(Solv-1) Solvent
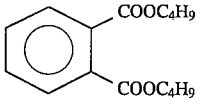
(Solv-2) Solvent, which is a mixture of the components listed below in the mixing ratio (volume ratio) of 1:1;
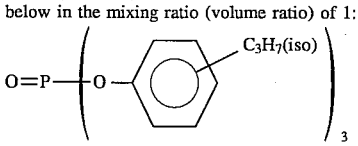
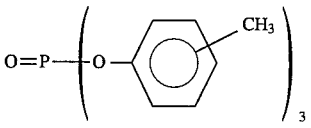
(Solv-3) Solvent
$O{=}P{-}(O{-}C_9H_{19}(iso))_3$
(Solv-4) Solvent
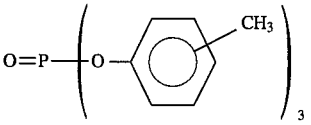
(Solv-5) Solvent
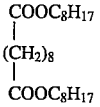

TABLE A-continued (Solv-6) Solvent, which is a mixture of the components listed below in the mixing ratio (volume ratio) of 80:20;

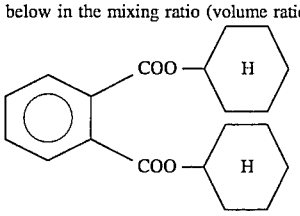

$C_8H_{17}CHCH(CH_2)_7COOC_8H_{17}$
O (Solv-7) Solvent
$C_8H_{17}CHCH(CH_2)_7COOC_8H_{17}$
O (Solv-8) Solvent

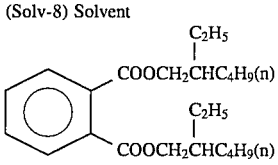

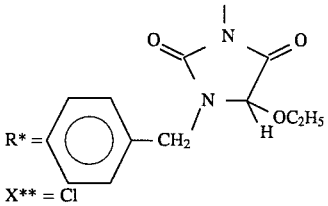

Example 2

Samples 201 to 234 were prepared exactly as in preparation of sample 101 in Example 1, except that the yellow coupler (ExY) and the high boiling point solvents (Solv-3, Solv-7) in the first layer, and the cyan coupler (ExC) and the high boiling point solvent (Solv-6) in the fifth layer in sample 101 were changed as shown in Tables 3 and 4 in preparing these samples 201 to 234.

Light exposure as in Example 1 was applied to each of these samples 201 to 234, followed by a processing as in Example 1 using a processing solution of running state. Density measurement as in Example 1 was effected on each processed sample so as to evaluate the magenta stain and cyan stain generated upon processing.

Further, each of these samples was preserved at 60° C. under a relative humidity of 70% for 40 days so as to evaluate the magenta stain and cyan stain during storage as in Example 1. Tables 3 and 4 also show the results of these evaluations.

Table 3 shows that, where yellow coupler Y-28 of the present invention is used in the first layer, the stain during storage is scarcely improved, though it is certainly possible to improve the stain upon processing. On the other hand, where cyan couplers IIC-3, IIC-4 and IIC-6 of the present invention are used in the fifth layer, the stain upon processing is scarcely improved, though it is certainly possible to improve the stain during storage to some extent.

However, where yellow couplers Y-28, Y-47 of the present invention and cyan couplers IIC-3, IIC-4, IIC-6, IIIC-15, IIIC-17 of the present invention are used together, it is possible to improve both the stains upon processing and during storage. It is seen that the improving effect is markedly greater than that expected from the effect produced in the case of independently using the yellow coupler alone or the cyan coupler alone of the present invention. Further, in the case of using cyan coupler IIC-5, a similar effect can certainly be produced, but the produced effect is so small as to be unsatisfactory in terms of the required function of the light-sensitive material.

Table 4 shows the produced effects in the case of using cyan coupler IIC-3 in combination with comparative coupler ExC-1. As apparent from Table 4, a clear improving effect can be obtained where cyan coupler IIC-3 is used in an amount of at least 50 mol %. Also, the improving effect is prominently increased where the amount of cyan coupler IIC-3 is at least 60 mol %. On the other hand, an improving effect can certainly be recognized to some extent where cyan coupler IIC-5 is used in combination with comparative coupler ExC-1. In this case, however, it is impossible to obtain a sufficient improving effect even if IIC-5 is used in an amount of 60 mol % or more.

As apparent from the experimental data, both stains upon processing and during storage can be markedly suppressed simultaneously in the case where the yellow coupler of the present invention is used in combination with the cyan coupler of the present invention. Further, the cyan coupler of the present invention can be used together with a cyan coupler which is not represented by formula (II) or (III) of the invention to obtain a satisfactory effect. In this case, however, it is desirable to use the cyan coupler of the present invention in an amount of at least 60 mol %.

TABLE 3

| Sample | First layer | | Fifth layer | | Stain upon processing | | Stain during storage | | |
|---|---|---|---|---|---|---|---|---|---|
| No. | Coupler | Solvent | Coupler | Solvent | Magenta | Cyan | Magenta | Cyan | Remarks |
| 201 | ExY (0.88) | Solv-3, Solv-7 (0.19) (0.19) | ExC-1 (0.34) | Solv-6 (0.15) | 0.08 | 0.06 | 0.18 | 0.10 | Comparative Example |
| 202 | ExY (0.88) | Solv-3, Solv-7 (0.19) (0.19) | ExC-2 (0.36) | Solv-6 (0.15) | 0.08 | 0.07 | 0.19 | 0.11 | Comparative Example |
| 203 | ExY (0.88) | Solv-3, Solv-7 (0.19) (0.19) | ExC-3 (0.30) | Solv-6 (0.15) | 0.11 | 0.10 | 0.21 | 0.15 | Comparative Example |
| 204 | ExY (0.88) | Solv-3, Solv-7 (0.19) (0.19) | IIC-3 (0.35) | Solv-6 (0.15) | 0.07 | 0.05 | 0.10 | 0.07 | Comparative Example |
| 205 | ExY (0.88) | Solv-3, Solv-7 (0.19) (0.19) | IIC-4 (0.37) | Solv-6 (0.15) | 0.07 | 0.06 | 0.10 | 0.08 | Comparative Example |
| 206 | ExY (0.88) | Solv-3, Solv-7 (0.19) (0.19) | IIC-5 (0.31) | Solv-6 (0.15) | 0.10 | 0.09 | 0.15 | 0.13 | Comparative Example |
| 207 | ExY (0.88) | Solv-3, Solv-7 (0.19) (0.19) | IIC-6 (0.32) | Solv-6 (0.15) | 0.07 | 0.06 | 0.10 | 0.08 | Comparative Example |
| 208 | Y-28 (0.73) | Solv-3, Solv-7 (0.16) (0.16) | ExC-1 (0.34) | Solv-6 (0.15) | 0.04 | 0.03 | 0.18 | 0.10 | Comparative Example |
| 209 | Y-28 (0.73) | Solv-3, Solv-7 (0.16) (0.16) | ExC-2 (0.36) | Solv-6 (0.15) | 0.04 | 0.04 | 0.19 | 0.11 | Comparative Example |
| 210 | Y-28 (0.73) | Solv-3, Solv-7 (0.16) (0.16) | ExC-3 (0.30) | Solv-6 (0.15) | 0.10 | 0.09 | 0.21 | 0.15 | Comparative Example |
| 211 | Y-28 (0.73) | Solv-3, Solv-7 (0.16) (0.16) | IIC-3 (0.35) | Solv-6 (0.15) | 0.02 | 0.02 | 0.06 | 0.05 | Present Invention |
| 212 | Y-28 (0.73) | Solv-3, Solv-7 (0.16) (0.16) | IIC-4 (0.37) | Solv-6 (0.15) | 0.03 | 0.02 | 0.07 | 0.05 | Present Invention |
| 213 | Y-28 (0.73) | Solv-3, Solv-7 (0.16) (0.16) | IIC-5 (0.31) | Solv-6 (0.15) | 0.05 | 0.05 | 0.12 | 0.08 | Comparative Example |
| 214 | Y-28 (0.73) | Solv-3, Solv-7 (0.16) (0.16) | IIC-6 (0.32) | Solv-6 (0.15) | 0.03 | 0.02 | 0.07 | 0.05 | Present Invention |
| 215 | Y-47 (0.68) | Solv-3, Solv-7 (0.16) (0.16) | ExC-1 (0.34) | Solv-6 (0.15) | 0.05 | 0.04 | 0.20 | 0.11 | Comparative Example |
| 216 | Y-47 (0.68) | Solv-3, Solv-7 (0.16) (0.16) | IIC-4 (0.37) | Solv-6 (0.15) | 0.02 | 0.01 | 0.06 | 0.04 | Present Invention |
| 217 | Y-47 (0.68) | Solv-3, Solv-7 (0.16) (0.16) | IIC-6 (0.32) | Solv-6 (0.15) | 0.03 | 0.02 | 0.06 | 0.04 | Present Invention |
| 218 | Y-47 (0.68) | Solv-3, Solv-7 (0.16) (0.16) | IIC-15 (0.44) | Solv-6 (0.15) | 0.03 | 0.01 | 0.07 | 0.03 | Present Invention |
| 219 | Y-47 (0.68) | Solv-3, Solv-7 (0.16) (0.16) | IIC-17 (0.48) | Solv-6 (0.15) | 0.03 | 0.01 | 0.07 | 0.04 | Present Invention |

TABLE 4

| Sample | First layer | | Fifth layer | | Stain upon processing | | Stain during storage | | |
|---|---|---|---|---|---|---|---|---|---|
| No. | Coupler | Solvent | Coupler | Solvent | Magenta | Cyan | Magenta | Cyan | Remarks |
| 220 | Y-28 | Solv-3, Solv-7 (0.16) (0.16) | ExC-1, IIC-3 (0.34) (0.0) 0% | Solv-6 | 0.04 | 0.03 | 0.18 | 0.10 | Comparative Example |
| 221 | Y-28 (0.73) | Solv-3, Solv-7 (0.16) (0.16) | ExC-1, IIC-3 (0.26) (0.09) 25% | Solv-6 (0.15) | 0.04 | 0.03 | 0.16 | 0.09 | Present Invention |
| 222 | Y-28 (0.73) | Solv-3, Solv-7 (0.16) (0.16) | ExC-1, IIC-3 (0.17) (0.17) 50% | Solv-6 (0.15) | 0.03 | 0.03 | 0.13 | 0.08 | Present Invention |
| 223 | Y-28 (0.73) | Solv-3, Solv-7 (0.16) (0.16) | ExC-1, IIC-3 (0.14) (0.20) 60% | Solv-6 (0.15) | 0.02 | 0.02 | 0.09 | 0.06 | Present Invention |
| 224 | Y-28 (0.73) | Solv-3, Solv-7 (0.16) (0.16) | ExC-1, IIC-3 (0.10) (0.24) 70% | Solv-6 (0.15) | 0.02 | 0.02 | 0.07 | 0.05 | Present Invention |
| 225 | Y-28 (0.73) | Solv-3, Solv-7 (0.16) (0.16) | ExC-1, IIC-3 (0.07) (0.27) 80% | Solv-6 (0.15) | 0.02 | 0.02 | 0.06 | 0.05 | Present Invention |
| 226 | Y-28 (0.73) | Solv-3, Solv-7 (0.16) (0.16) | ExC-1, IIC-3 (0.00) (0.34) 100% | Solv-6 (0.15) | 0.02 | 0.02 | 0.06 | 0.05 | Present Invention |
| 227 | Y-28 (0.73) | Solv-3, Solv-7 (0.16) (0.16) | ExC-1, IIC-5 (0.34) (0.00) 0% | Solv-6 (0.15) | 0.04 | 0.03 | 0.18 | 0.10 | Comparative Example |
| 228 | Y-28 (0.73) | Solv-3, Solv-7 (0.16) (0.16) | ExC-1, IIC-5 (0.26) (0.09) | Solv-6 (0.15) | 0.04 | 0.03 | 0.16 | 0.10 | Comparative Example |

TABLE 4-continued

| Sample | First layer | | Fifth layer | | Stain upon processing | | Stain during storage | | |
|---|---|---|---|---|---|---|---|---|---|
| No. | Coupler | Solvent | Coupler | Solvent | Magenta | Cyan | Magenta | Cyan | Remarks |
| 229 | Y-28 (0.73) | Solv-3, Solv-7 (0.16) (0.16) | 25% ExC-1, IIC-5 (0.17) (0.17) | Solv-6 (0.15) | 0.04 | 0.03 | 0.14 | 0.09 | Comparative*1 Example |
| 230 | Y-28 (0.73) | Solv-3, Solv-7 (0.16) (0.16) | 50% ExC-1, IIC-5 (0.14) (0.20) | Solv-6 (0.15) | 0.04 | 0.04 | 0.13 | 0.08 | Comparative Example |
| 231 | Y-28 (0.73) | Solv-3, Solv-7 (0.16) (0.16) | 60% ExC-1, IIC-5 (0.10) (0.24) | Solv-6 (0.15) | 0.04 | 0.04 | 0.12 | 0.08 | Comparative Example |
| 232 | Y-28 (0.73) | Solv-3, Solv-7 (0.16) (0.16) | 70% ExC-1, IIC-5 (0.07) (0.27) | Solv-6 (0.15) | 0.05 | 0.05 | 0.12 | 0.08 | Comparative Example |
| 233 | Y-28 (0.73) | Solv-3, Solv-7 (0.16) (0.16) | 80% ExC-1, IIC-5 (0.00) (0.34) | Solv-6 (0.15) | 0.05 | 0.05 | 0.12 | 0.08 | Comparative Example |
| 234 | Y-28 (0.73) | Solv-3, Solv-7 (0.16) (0.16) | 100% ExC-1, (0.17) ExC-2, (0.14) IIC-5, (0.14) 40% | Solv-6 (0.15) | 0.04 | 0.04 | 0.15 | 0.09 | Comparative Example *2 |

*1 Cyan coupler composition equal to that in red-sensitive layer in Example 9 of USSN 08/017,447
*2 Cyan coupler composition equal to that in red-sensitive layer in Example 2 of USSN 08/017,447

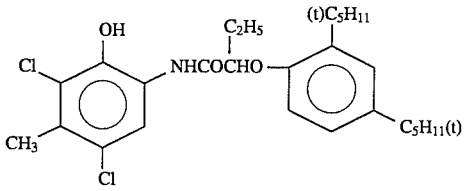

ExC-1

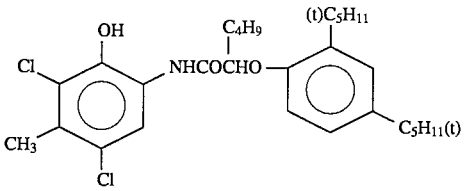

ExC-2

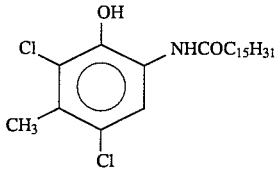

ExC-3

What is claimed is:

1. A silver halide color photographic light-sensitive material comprising at least one red-sensitive silver halide emulsion layer, at least one green-sensitive silver halide emulsion layer, and at least one blue-sensitive silver halide emulsion layer, which are formed on a support, wherein the blue-sensitive silver halide emulsion layer contains at least one acylacetamide yellow dye-forming coupler represented by formula (I), and the red-sensitive silver halide emulsion layer contains at least one cyan coupler represented by formula (II) or (III):

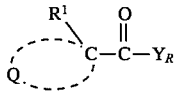

(I)

where $R^1$ represents an alkyl group having 2 to 20 carbon atoms, Q represents a nonmetallic atomic group required to form, together with C, a 3- to 5-membered carbocyclic ring or a 3- to 5-membered heterocyclic ring containing at least one heteroatom selected from the group consisting of N, S, O, and P in the ring, $R^1$ is not hydrogen and does not combine with Q to form a ring, and $Y_R$ represents a residue remaining after removing an acyl group:

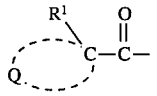

(I')

from the acylacetamide yellow dye-forming coupler;

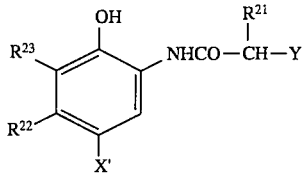

(II)

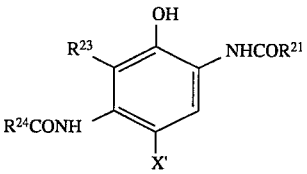

(III)

where, in formula (II), $R^{21}$ represents an alkyl group; in formula (III), $R^{21}$ represents an alkyl group, an aryl group, or a heterocyclic group; and in formula (II) or (III), $R^{22}$ represents an alkyl group having 2 or more carbon atoms, $R^{23}$ represents a hydrogen atom, a halogen atom, an alkyl group, an aryl group, an alkoxy group, an aryloxy group, a carbonamido group, or a ureido group, $R^{24}$ represents an alkyl group, an aryl group, a heterocyclic group, an alkoxy group, an aryloxy group, or an amino group, X' represents a hydrogen atom or a coupling-off group, and Y represents an alkyl group or an aryloxy group.

2. The light-sensitive material according to claim 1, wherein the cyan coupler represented by formula (II) or (III) is contained in an amount of at least 60 mol % based on the total amount of all cyan couplers used.

3. The light-sensitive material according to claim 1, wherein, in formula (II), $R^{21}$ represents an alkyl group having 2 to 8 carbon atoms, $R_{22}$ represents ethyl, $R^{23}$ represents chlorine, X' represents chlorine, and Y represents 2,4-di-tert-amylphenoxy.

4. The light-sensitive material according to claim 1, wherein the acylacetamide yellow dye-forming coupler is represented by formula (Y) :

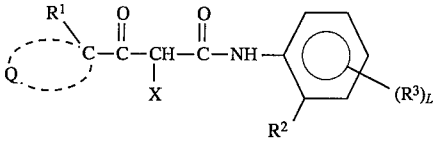

(Y)

wherein $R^1$ and Q are defined as in formula (I); $R^2$ represents a hydrogen atom, a halogen atom, an alkoxy group, and aryloxy group, an alkyl group, or an amino group; $R^3$ represents a group which can be substituted on the benzene ring and is selected from the group consisting of a halogen atom, an alkyl group, an aryl group, an alkoxy group, an aryloxy group, an alkoxycarbonyl group, an aryloxycarbonyl group, a carbonamido group, a sulfonamido group, a carbamoyl group, a sulfamoyl group, an alkysulfonyl group, a ureido group, a sulfamoylamino group, an alkoxycarbonylamino group, an alkoxysulfonyl group, an acyloxy group, nitro, a heterocyclic group, cyano, an acyl group, an alkylsulfonyloxy group, and an arylsulfonyloxy group, X represents a hydrogen atom or a group which can be split off upon a coupling reaction with an oxidized form of an aromatic primary amine developing agent, and L represents an integer from 0 to 4, such that if L represents a plural number each $R^3$ group may be the same or different.

5. The light-sensitive material according to claim 4, wherein X is a heterocyclic group which combines with a coupling active site by nitrogen, an aryloxy group, an arylthio group, an acyloxy group, an alkylsulfonyloxy group, an arylsulfonyloxy group, a heterocyclic oxy group, and a halogen atom.

6. The light-sensitive material according to claim 4, wherein $R^1$ is a substituted alkyl group having 1 to 20 carbon atoms, wherein substituents of said substituted alkyl group are selected from the group consisting of a halogen atom, an alkyl group, an alkoxy group, nitro, an amino group, a carbonamido group, a sulfonamido group, and an acyl group.

7. The light sensitive material according to claim 4, wherein Q represents a non-metallic atomic group required to form together with C, a substituted or unsubstituted 3- to 5-membered carbocyclic ring which has 3 to 30 carbon atoms, and a substituted or unsubstituted 3- to 5-membered heterocyclic group which contains at least one heteroatom selected from N, S, O, and P, and has 2 to 30 carbon atoms wherein substituents for said carbocyclic and heterocyclic rings are selected from the group consisting of a halogen atom, hydroxyl, an alkyl group, an aryl group, an acyl group, an alkoxy group, an aryloxy group, cyano, an alkoxycarbonyl group, an alkylthio group, and an arylthio group.

8. The light-sensitive material according to claim 4, wherein $R^2$ represents a halogen atom, a substituted or unsubstituted alkoxy group having 1 to 30 carbon atoms, a substituted or unsubstituted aryloxy group having 6 to 30 carbon atoms, a substituted or unsubstituted alkyl group having 1 to 30 carbon atoms, and a substituted or unsubstituted amino group, having 0 to 30 carbons, wherein substituents for said alkoxy group, aryloxy group, alkyl group and amino group are selected from the group consisting of a halogen atom, an alkyl group, an alkoxy group, and a aryloxy group.

9. The light-sensitive material according to claim 1, wherein in formula (II) $R^{21}$ is ethyl or butyl; Y is an alkyl group of 8 to 12 carbon atoms or an aryloxy group having one or two substituents selected from a chlorine atom, t-butyl, t-amyl and t-octyl; $R^{22}$ is ethyl; and $R^{23}$ is a hydrogen atom.

10. The light sensitive material according to claim 1, wherein in formula (III) $R^{21}$ is heptafluoropropyl, 2-chlorophenyl, 2,6-dichlorophenyl, or pentafluorophenyl; $R^{23}$ is a hydrogen atom; and $R^{24}$ is an alkyl group or the same group as $R^{21}$.

11. The light-sensitive material according to claim 1, wherein $R^1$ is ethyl, n-propyl, n-butyl or benzyl.

* * * * *